US008251755B2

(12) United States Patent
Mulfinger et al.

(10) Patent No.: US 8,251,755 B2
(45) Date of Patent: Aug. 28, 2012

(54) CONNECTOR WITH A LATERALLY MOVING CONTACT

(75) Inventors: Robert Neil Mulfinger, York Haven, PA (US); Richard Elof Hamner, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 166 days.

(21) Appl. No.: 12/814,735

(22) Filed: Jun. 14, 2010

(65) Prior Publication Data

US 2011/0306251 A1 Dec. 15, 2011

(51) Int. Cl.
*H01R 13/502* (2006.01)

(52) U.S. Cl. ..... 439/700; 439/289

(58) Field of Classification Search ..... 439/700, 439/824, 289; 324/754.14, 755.05
See application file for complete search history.

(56) References Cited

U.S. PATENT DOCUMENTS 1,336,066 A * 4/1920 Briggs et al. ..... 200/532
1,349,405 A * 8/1920 Brown ..... 307/9.1
2,265,998 A * 12/1941 Bruno ..... 200/51.1
3,185,955 A * 5/1965 Keller ..... 439/357
3,274,534 A * 9/1966 Shortridge ..... 439/700
3,274,535 A * 9/1966 Turner ..... 367/91
3,356,983 A * 12/1967 Johnson, Jr. ..... 439/67
3,378,810 A * 4/1968 Dorrell ..... 439/436
3,441,898 A * 4/1969 Nodfelt ..... 439/289
3,458,851 A * 7/1969 Stella ..... 439/436
3,534,320 A * 10/1970 Rushing ..... 439/157
4,014,600 A * 3/1977 Gisewsky ..... 439/289
4,085,990 A 4/1978 Jayne
4,480,569 A 11/1984 Van der Veen et al.
4,518,210 A 5/1985 Morrison
4,533,203 A * 8/1985 Feldman et al. ..... 439/64
4,603,928 A 8/1986 Evans
4,626,056 A 12/1986 Andrews, Jr. et al.
4,629,270 A 12/1986 Andrews, Jr. et al.
4,693,529 A 9/1987 Stillie
4,717,345 A * 1/1988 Gordon et al. ..... 439/67
4,731,698 A 3/1988 Millot et al.
4,744,764 A * 5/1988 Rubenstein ..... 439/62

(Continued)

FOREIGN PATENT DOCUMENTS

EP 1 253 674 A2 10/2002

(Continued)

OTHER PUBLICATIONS

European Search Report, European Application No. 11169816.3, European Filing Date Jun. 14, 2011.

(Continued)

*Primary Examiner* — Neil Abrams

(57) ABSTRACT

A connector includes a housing, a contact, an angled interface, and a resilient member. The contact is disposed in the housing and includes a mating end and an interface end. The angled interface includes a sliding surface that is oriented at an oblique angle with respect to the longitudinal axis. The resilient member is coupled with the contact and the housing and is configured to apply a force to the contact in a direction that is angled with respect to the longitudinal axis. The mating end of the contact engages a conductive element of a mating connector and the interface end of the contact slides along the sliding surface of the angled interface when the contact is moved in a mating direction toward the conductive element. The angled interface translates movement of the contact in the mating direction into lateral movement across the conductive element.

21 Claims, 13 Drawing Sheets

U.S. PATENT DOCUMENTS 4,768,971 A * 9/1988 Simpson ..... 439/329
4,830,623 A * 5/1989 Owens et al. ..... 439/71
4,840,569 A 6/1989 Cabourne
4,871,315 A * 10/1989 Noschese ..... 439/67
4,881,901 A 11/1989 Mendenhall et al.
4,892,487 A * 1/1990 Dranchak et al. ..... 439/260
4,895,530 A * 1/1990 Gugelmeyer et al. ..... 439/311
5,092,781 A 3/1992 Casciotti et al.
5,102,342 A 4/1992 Marian
5,171,154 A 12/1992 Casciotti et al.
5,205,739 A 4/1993 Malo et al.
5,227,718 A * 7/1993 Stowers et al. ..... 324/755.05
5,227,959 A * 7/1993 Rubinstein et al. ..... 361/785
5,228,863 A 7/1993 Campbell et al.
5,248,261 A 9/1993 Conroy-Wass et al.
5,338,232 A * 8/1994 Bernier ..... 439/733.1
5,366,380 A * 11/1994 Reymond ..... 439/66
5,529,504 A * 6/1996 Greenstein et al. ..... 439/91
5,947,749 A * 9/1999 Rathburn ..... 439/66
6,060,891 A * 5/2000 Hembree et al. ..... 324/755.04
6,062,872 A 5/2000 Strange et al.
6,077,090 A 6/2000 Campbell et al.
6,181,149 B1 * 1/2001 Godfrey et al. ..... 324/750.19
6,312,295 B2 * 11/2001 Nishimatsu ..... 439/700
6,411,517 B1 6/2002 Babin
6,672,878 B2 1/2004 Dean
6,716,043 B2 * 4/2004 Ishizuka ..... 439/131
6,776,624 B2 * 8/2004 Suematsu ..... 439/71
6,811,406 B2 * 11/2004 Grube ..... 439/66
6,814,585 B2 * 11/2004 Bedell et al. ..... 439/66
6,935,901 B2 * 8/2005 Simpson et al. ..... 439/700
7,081,025 B2 * 7/2006 Zhang et al. ..... 439/700
7,114,973 B2 * 10/2006 Haggerty ..... 439/246
7,297,015 B1 11/2007 Desrosiers et al.
7,374,441 B2 5/2008 Rubenstein
7,419,400 B1 9/2008 Taylor et al.
7,425,134 B1 9/2008 Taylor
7,438,582 B2 10/2008 Taylor
7,479,794 B2 * 1/2009 Chartarifsky et al. ... 324/755.05
7,632,106 B2 12/2009 Nakamura
7,645,164 B1 * 1/2010 Ju ..... 439/591
2005/0064765 A1 3/2005 Simpson et al.
2005/0064766 A1 3/2005 Zhang et al.
2007/0097662 A1 5/2007 Dean
2008/0227314 A1 9/2008 Taylor
2011/0306251 A1 * 12/2011 Mulfinger et al. ..... 439/733.1

FOREIGN PATENT DOCUMENTS

EP 1 580 515 A1 9/2005

OTHER PUBLICATIONS

Neoconix PCBeam™ Interposer Design Guide, Neoconix, Rev. 070925, 4 pgs.

* cited by examiner

CONNECTOR WITH A LATERALLY MOVING CONTACT

BACKGROUND OF THE INVENTION

The subject matter herein relates generally to electrical connectors and, more particularly, to connectors that include contacts that mate with one another.

Known connectors include contacts disposed within or coupled with a housing. The housings mate with one another to electrically couple the contacts. Once the contacts are joined with one another, the connectors communicate data signals and/or power between each other via the coupled contacts. Some known connectors include contacts that mate with contact pads of another connector. For example, a connector system may include a first connector that includes several contacts while a second connector includes several substantially flat contact pads. By way of example only, the second connector may be a printed circuit board that includes contact pads disposed on one side of the board. The contacts engage the contact pads to electrically couple the contacts with the contact pads.

The contact pads may include or be formed from metals or metal alloys that may develop an insulating layer of surface contamination when exposed to the environment over time. This layer may be present on the surface of the contact pads that mate with the first connector. The layer may negatively impact the coupling between the connector and the contact pads. For example, the layer may have a greater resistivity than the contact pad and increase the resistance of the coupling between the contacts and the contact pads.

In order to improve the electrical coupling between the contacts and the contact pads, the layer of surface contamination may be locally removed from the contact pad by laterally moving the contact across the surface of the contact pad. The lateral movement of the contact may scrape off or otherwise remove the layer of surface contamination from a portion of the contact pad. The contact engages the contact pad where the layer has been removed for an improved electrical coupling between the contact and the contact pad.

But, with some known connectors, in order to laterally move the contact across the contact pad and remove the layer of surface contamination, the connector in which the contact is disposed must be laterally moved with respect to the connector that includes the contact pad. In some applications, there is insufficient room to laterally move the connectors relative to each other. Additionally, lateral movement of the connectors relative to each other may result in misalignment of the contacts relative to the contact pads. Such misalignment may prevent some of the contacts from mating with the contact pads.

A need exists for a connector that mates a contact with a conductive pad of another connector while removing a layer of surface contamination from the conductive pad. Removing the layer of surface contamination may improve the electrical coupling between the contact and the conductive pad by reducing the resistance of the conductive pathway that extends between the contact and the conductive pad.

BRIEF DESCRIPTION OF THE INVENTION

In one embodiment, a connector is provided. The connector includes a housing, a contact, an angled interface, and a resilient member. The housing includes a front end with a channel inwardly extending from the front end. The contact is disposed in the channel and is elongated along a longitudinal axis. The contact includes a mating end and an interface end.

The angled interface is slidably coupled to the interface end of the contact. The angled interface includes a sliding surface that is oriented at an oblique angle with respect to the longitudinal axis. The resilient member is coupled with the contact and the housing and is configured to apply a force to the contact in a direction that is angled with respect to the longitudinal axis. The mating end of the contact engages a conductive element of a mating connector and the interface end of the contact slides along the sliding surface of the angled interface when the contact is moved in a mating direction toward the conductive element. The angled interface translates movement of the contact in the mating direction into lateral movement with respect to the mating direction across the conductive element.

In another embodiment, another connector is provided. The connector includes a housing, a contact, and an angled interface. The contact is coupled with the housing and includes a mating end and an interface end. The angled interface is disposed within the housing and is arranged for sliding engagement with the interface end of the contact. When the housing is moved in a mating direction toward a mating connector and the mating end of the contact engages a conductive element of the mating connector, further movement of the housing in the mating direction causes the interface end of the contact to slidably move along the angled interface. The angled interface imparts translational movement of the contact with respect to the housing and the mating end of the contact moves laterally across the conductive element.

In another embodiment, another connector is provided. The connector includes a body, a mating array including a contact, and a rotating arm. The rotating arm couples the mating array with the body and rotates toward the body when the body is moved toward a mating connector and the contact engages a conductive element of the mating connector. The rotating arm translates movement of the body toward the mating connector into lateral movement of the mating array and contact. The contact laterally wipes across the conductive element of the mating connector.

DETAILED DESCRIPTION OF THE INVENTION

Figure 1:
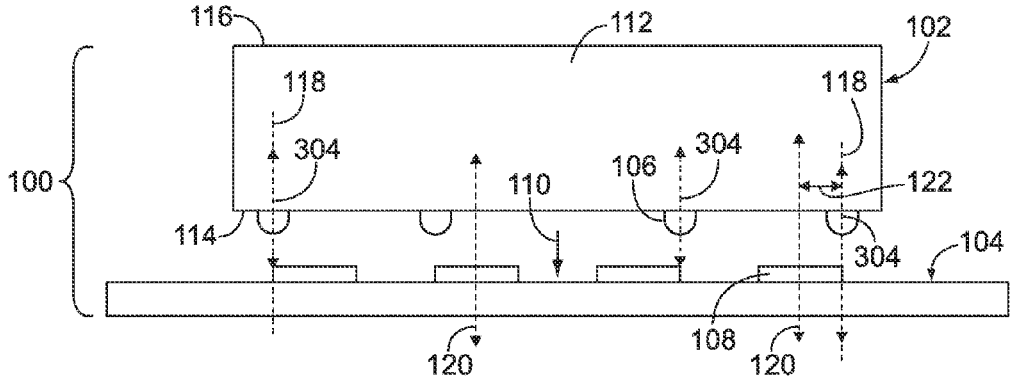
FIG. 1 is an elevational view of a decoupled connector system in accordance with one embodiment of the present disclosure.
Figure 2:
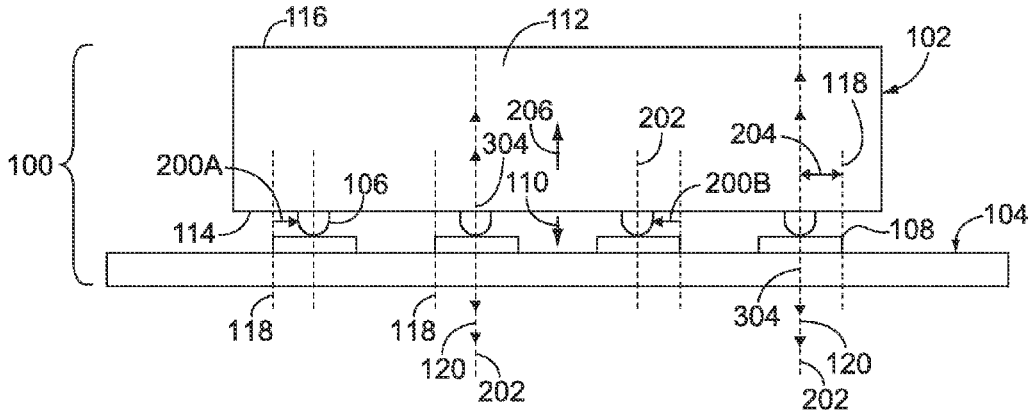
FIG. 2 is an elevational view of a coupled or mated connector system in accordance with one embodiment of the present disclosure.

FIG. 1 is an elevational view of a decoupled connector system 100 in accordance with one embodiment of the present disclosure. FIG. 2 is an elevational view of a coupled or mated connector system 100 in accordance with one embodiment of the present disclosure. The system 100 includes two connectors 102, 104 that mate with one another to communicate data signals and/or electric power between the connectors 102, 104. The connector 104 may be referred to herein as a mating connector. The first connector 102 includes a housing 112 that extends from a front end 114 to a back end 116. Several contacts 106 are disposed within the housing 112 and protrude from the front end 114. Alternatively, the contacts 106 may be recessed within the housing 112 such that the contacts 106 do not protrude from the front end 114. The number of contacts 106 shown in FIGS. 1 and 2 is provided merely as an example.

The contacts 106 engage corresponding conductive elements 108 of the second connector 104. The contact 106 and the conductive element 108 include, or are formed from, conductive materials, such as metals or metal alloys. In one embodiment, the contacts 106 of the first connector 102 are elongated contacts. Alternatively, the contacts 106 may be non-elongated contacts. For example, the contacts 106 may not be elongated in a mating direction 110 that the first connector 102 and/or second connector 104 are moved relative to each other. The second, or mating, connector 104 may be a circuit board, such as a printed circuit board (PCB), with the conductive elements 108 being contacts that mate with the contacts 106. The conductive elements 108 may be substantially flat contact pads disposed on one side of the circuit board. The number of conductive elements 108 is shown merely as an example. Alternatively, the second connector 104 may be a connector other than a circuit board.

The connectors 102, 104 mate with one another by moving the first connector 102 toward the second connector 104 in the mating direction 110 or by moving the second connector 104 in a direction that is opposite of the mating direction 110 until the contacts 106 of the first connector 102 engage the conductive elements 108 of the second connector 104. For example, at least one of the connectors 102, 104 is moved toward the other of the connectors 102, 104. As shown in FIG. 1, the mating direction 110 is oriented approximately parallel to a longitudinal axis 304 of the contact 106. Prior to mating the connectors 102, 104, each of the contacts 106 is located at an initial position 118 at the front end 114 of the housing 112. The spacing between the initial positions 118 of adjacent contacts 106 may be uniform or non-uniform across the front end 114. The initial position 118 of each contact 106 may correspond to the location of the longitudinal axis 304 of the contact 106 along the front end 114. The conductive elements 108 of the second connector 104 may have center lines or axes 120 that extend through the center of the conductive elements 108. As shown in FIG. 1, the longitudinal axes 304 of the contacts 106 are laterally spaced apart from the center axes 120 of the conductive elements 108. For example, the longitudinal axis 304 of a contact 106 and the center axis 120 of a conductive element 108 that mates with the contact 106 may be spaced apart by a lateral gap 122 along a direction that is transverse or perpendicular to the longitudinal axis 304.

When the connectors 102, 104 mate with one another, the contacts 106 are caused to move laterally across the conductive elements 108 as will be explained in more detail hereinbelow. For example, as shown in FIG. 2, the contacts 106 wipe across the upper surfaces of the conductive elements 108 in wiping directions 200A, 200B that are oriented perpendicular to the mating direction 110. Some contacts 106 may move in the wiping direction 200A while other contacts 106 move in the wiping direction 200B toward the center axes 120 of the conductive elements 108. Different subsets of the contacts 106 in the array may move in different wiping directions 200A, 200B. For example, the wiping direction 200A of one subset of contacts 106 may be oriented opposite of the wiping direction 200B of another subset of contacts 106. Alternatively, all of the contacts 106 may move in a common wiping direction 200A or 200B. The contacts 106 laterally move in the wiping directions 200A, 200B from the initial positions 118 to mated positions 202 (shown in FIG. 2). The contacts 106 are laterally displaced by a lateral distance 204 when the connectors 102, 104 mate. In the illustrated embodiment, the lateral distance 204 is approximately the same as the lateral gap 122 (shown in FIG. 1) between the initial positions 118 of the contacts 106 and the center axes 120 of the conductive elements 108 such that the longitudinal axes 304 of the contacts 106 are aligned with the center axes 120 of the conductive elements 108. The contacts 106 may move in the wiping direction 200 relative to the connectors 102, 104. The connectors 102, 104 may move relative to each other such that the connectors 102, 104 move toward one another along the mating direction 110 while the contacts 106 simultaneously or concurrently move in the lateral wiping directions 200A, 200B.

The contacts 106 may move in the wiping directions 200A, 200B independent of the movement of the connector 102 to prevent misalignment of the contacts 106 with the conductive elements 108. For example, if the contacts 106 were able to laterally move across the conductive elements 108 only if the connector 102 also moved in the wiping direction 200A or 200B, then the contacts 106 may become misaligned with the conductive elements 108. The independent lateral movement of the contacts 106 permits an operator to align the connectors 102, 104 with one another along the mating direction 110 while still achieving a wiping motion of the contacts 106 across the conductive elements 108 in the wiping directions 200A, 200B.

The wiping movement of the contacts 106 across the conductive elements 108 may improve an electrical coupling between the contacts 106 and conductive elements 108. For example, the wiping movement of the contacts 106 across the conductive elements 108 may remove one or more layers of surface contamination on the conductive elements 108. Removal of the surface contamination may reduce the resistivity of the coupling between the contacts 106 and conductive elements 108.

As shown in FIGS. 1 and 2, the contacts 106 laterally move in the wiping directions 200A, 200B relative to both the housing 112 of the connector 102 and the connector 104. For example, the contacts 106 move within the housing 112 without the housing 112 laterally moving with respect to the connector 104. The contacts 106 may return to the initial positions 118 when the connectors 102, 104 decouple from one another. For example, the connector 102 may be retreated away from the connector 104 in a decoupling direction 206 (shown in FIG. 2) to separate the contacts 106 and conductive elements 108 from one another and break the electrical coupling between the contacts 106 and conductive elements 108. As the connector 102 moves away from the connector 104 in the decoupling direction 206, the contacts 106 return to the initial positions 118 as shown in FIG. 1. For example, the contacts 106 may laterally move within and relative to the housing 112 back to the initial positions 118.

Figure 3:
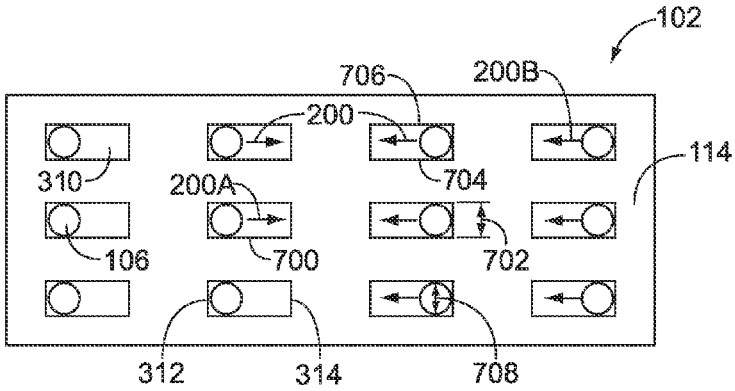
FIG. 3 is an illustration of a front end of a connector shown in FIG. 1 in accordance with one embodiment of the present disclosure.

FIG. 3 is an illustration of the front end 114 of the connector 102 in accordance with one embodiment of the present disclosure. Channels 310 may be arranged in an array across the front end 114. Each of the channels 310 is bounded by opposing end walls 312, 314 and opposing side walls 704, 706. The channels 310 include contacts 106 that protrude from the front end 114. The contacts 106 move in the wiping directions 200A, 200B within the channels 310 during mating of the connector 102 with the connector 104. In the illustrated embodiment, different subsets of the contacts 106 move in different wiping directions 200A, 200B. For example, some contacts 106 may move in a wiping direction 200A from the wall 312 toward the wall 314 while other contacts 106 move in a wiping direction 200B from the wall 314 toward the wall 312. The channels 310 may extend inward from the front end 114 to define openings 700 along the front end 114. The openings 700 are elongated in directions parallel to the wiping directions 200A, 200B.

The openings 700 have a width dimension 702 in a direction that is angled with respect to the corresponding wiping direction 200A or 200B. For example, the width dimension 702 may extend in a direction that is perpendicular to the wiping direction 200A or 200B of the contact 106 in the channel 310. The width dimension 702 may be sufficiently large to permit movement of the contacts 106 in the wiping direction 200A or 200B, but small enough to constrain movement of the contacts 106 to the wiping direction 200A or 200B. For example, the width dimension 702 may be slightly larger than a width dimension 708 of the contacts 106 to permit movement of the contacts 106 in the wiping directions 200A, 200B yet prevent significant movement of the contacts 106 in directions that are angled with respect to the wiping directions 200A, 200B.

Figure 5:
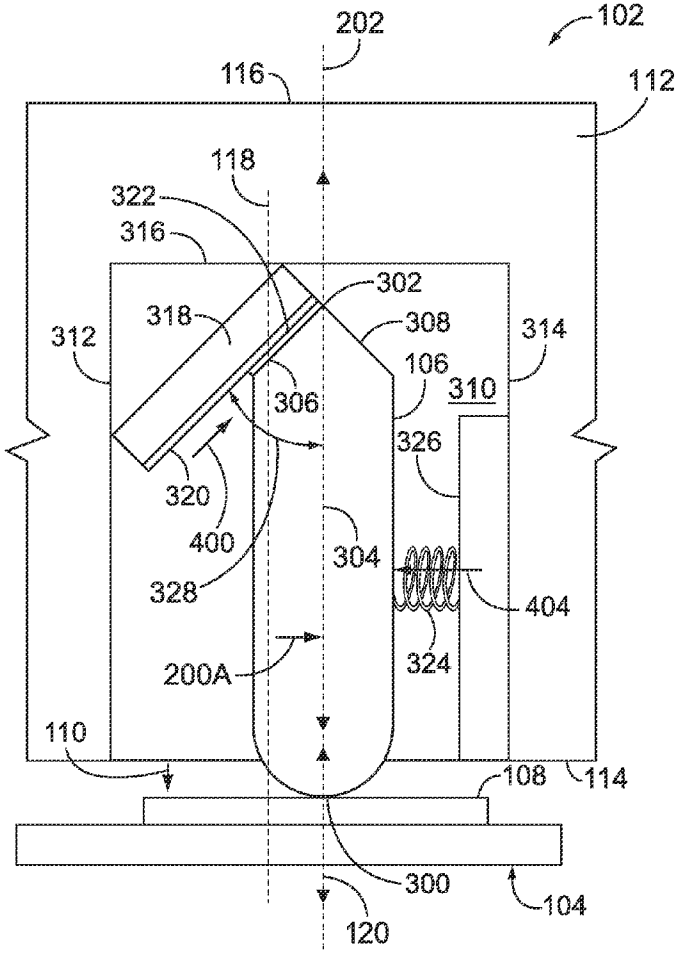
FIG. 5 is a schematic illustration of the contact shown in FIG. 1 in a mated position shown in FIG. 2 in accordance with one embodiment of the present disclosure.
Figure 4:
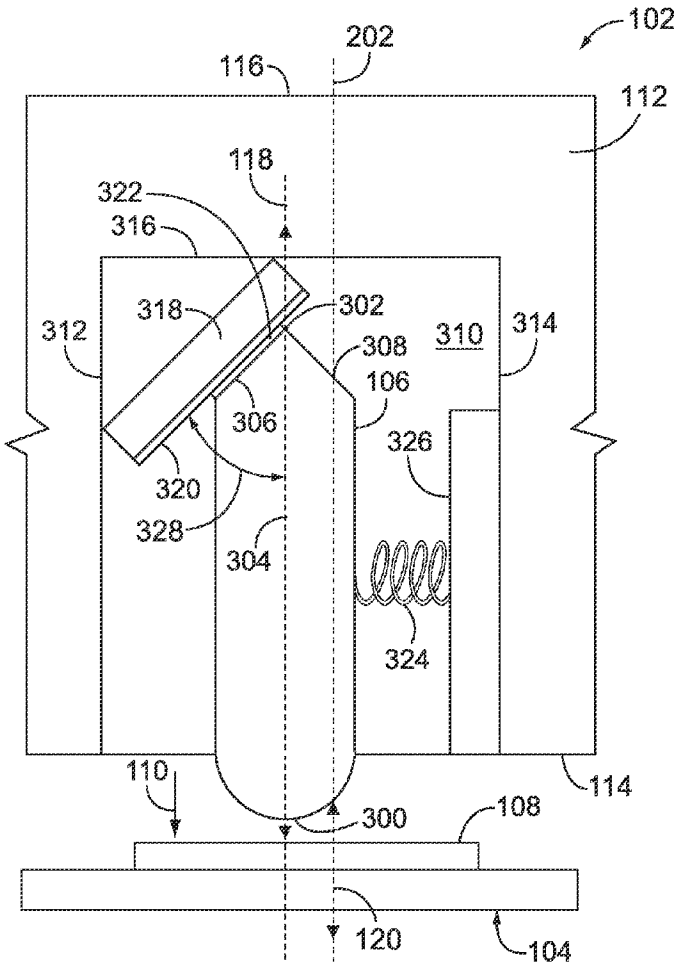
FIG. 4 is a schematic illustration of a contact of the connector shown in FIG. 1 in an initial position also shown in FIG. 1 in accordance with one embodiment of the present disclosure.

FIG. 4 is a schematic illustration of one of the contacts 106 of the connector 102 in the initial position 118 (shown in FIG. 1) in accordance with one embodiment of the present disclosure. FIG. 5 is a schematic illustration of the contact 106 in the mated position 202 (shown in FIG. 2) with respect to the conductive element 108 in accordance with one embodiment of the present disclosure. The contact 106 is disposed within a channel 310 of the housing 112 (shown in FIG. 1). For example, the channel 310 may be an interior section of the housing 112 that is bounded by opposing end walls 312, 314 and an interconnecting wall 316. As shown in FIGS. 4 and 5, the channel 310 is located inside the housing 112 with the interconnecting wall 316 separated from the back end 116 of the housing 112. Alternatively, the interconnecting wall 316 and the back end 116 may be the same component or portion of the housing 112.

The front end 114 of the housing 112 opposes the interconnecting wall 316. The contact 106 may be an elongated contact that extends from an interface end 302 to a mating end 300 along the longitudinal axis 304. Alternatively, the contact 106 may be a non-elongated contact. For example, the contact 106 may not be longer between the interface end 302 and the mating end 300 than in another direction. While the mating end 300 is shown as a rounded tip, alternatively the mating end 300 may have a different shape. The illustrated interface end 302 includes sides 306, 308 that are angled with respect to one another. For example, the sides 306, 308 may be approximately planar surfaces that are obliquely or perpendicularly oriented with respect to each other. The sides 306, 308 also are angled with respect to the longitudinal axis 304. In the illustrated embodiment, the sides 306, 308 are oriented at approximately 45 degrees with respect to the longitudinal axis 304. In another embodiment, one or more of the sides 306, 308 may be oriented at a different angle with respect to the longitudinal axis 304. Alternatively, the interface end 302 includes only the side 306. In another embodiment, the interface end 302 may be rounded in a manner similar to the mating end 300.

The channel 310 includes an angled interface 318 that is angled with respect to the longitudinal axis 304 of the contact 106. For example, the angled interface 318 may include a sliding surface 320 that is obliquely oriented with respect to the longitudinal axis 304. The sliding surface 320 may be oriented at an angle 328 with respect to the longitudinal axis 304. As shown in FIGS. 4 and 5, the angle 328 is an acute angle of approximately 45 degrees. Alternatively, the angle 328 may be a different angle, such as 30 degrees. The sliding surface 320 may include or be formed from a conductive material, such as one or more metals or metal alloys. The angled interface 318 and/or sliding surface 320 may be electrically coupled with a source or recipient (not shown) of the data and/or power that is electrically communicated between the connectors 102, 104. For example, the sliding surface 320 may be a contact pad similar to the conductive element 108 that receives data signals communicated from the connector 104 to the connector 102 via the contacts 106 and conductive elements 108.

The angled interface 318 is slidably coupled with the interface end 302 of the contact 106. For example, the angled interface 318 may slidably engage one of the sides 306, 308 of the interface end 302. The interface end 302 may remain electrically coupled with the angled interface 318 while the interface end 302 slides along the angled interface 318. For example, a conductive pathway that communicates data and/or power between the connectors 102, 104 via the contact 106 may extend across the interface between the sliding surface 320 and the interface end 302 of the contact 106. In the illustrated embodiment, the side 306 of the contact 106 includes a coating 322 that is disposed between the side 306 and the angled interface 318. The coating 322 may include, or be formed from, one or more conductive materials. The coating 322 may be formed of a material that reduces the coefficient of friction between the side 306 and the sliding surface 320 to permit the interface end 302 to slide more easily along the angled interface 318.

As shown in FIGS. 4 and 5, the interface end 302 of the contact 106 slides along the angled interface 318 as the connector 102 is moved in the mating direction 110 to mate with the connector 104. For example, when the longitudinal axis 304 of the contact 106 is in the initial position 118 (which may be separated from the center axis 120 of the conductive element 108), the side 306 is located in an initial position along the sliding surface 320 of the angled interface 318. When the connector 102 is moved in the mating direction 110 toward the connector 104, the mating end 300 of the contact 106 engages the conductive element 108. In one embodiment, after the mating end 300 abuts the conductive element 108, continued movement of the connector 102 in the mating direction 110 may cause the contact 106 to slide along the angled interface 318. For example, the continued movement of the connector 102 in the mating direction 110 may impart a force on the conductive element 108 in the mating direction 110 and an approximately equal and opposite force in an opposite direction. The force in the opposite direction is applied by the interface end 302 of the contact 106 onto the angled interface 318. The angled orientation of the angled interface 318 with respect to the contact 106 may translate the force applied by the contact 106 onto the angled interface 318 into a sliding movement of the contact 106 along the angled interface 318. For example, the side 306 of the contact 106 may slide along the sliding surface 320 in a sliding direction 400 (shown in FIG. 5).

The movement of the contact 106 in the sliding direction 400 laterally displaces the contact 106 with respect to the conductive element 108. As shown in FIG. 5, the movement of the interface end 302 of the contact 106 along the angled interface 318 in the sliding direction 400 also moves the mating end 300 of the contact 106 in the wiping direction 200A across the conductive element 108. Alternatively, the contact 106 may move in the wiping direction 200B (shown in FIG. 2). The contact 106 may move in the wiping direction 200A such that the longitudinal axis 304 of the contact 106 is aligned with the center axis 120 of the conductive element 108. Alternatively, the contact 106 may move such that the longitudinal axis 304 of the contact 106 moves toward the center axis 120 of the conductive element 108, but is not aligned with the center axis 120. The wiping direction 200A may be laterally oriented with respect to the mating direction 110. For example, the movement of the connector 102 in the mating direction 110 may cause the contact 106 to simultaneously move across the conductive element 108 in the wiping direction 200A. The engagement between the angled interface 318 in the connector 102 and the interface end 302 of the contact 106 may translate the movement of the contact 106 and the connector 102 in the mating direction 110 into lateral movement of the contact 106 in the wiping direction 200A while the connector 102 continues to move in the mating direction 110. The contact 106 moves in the wiping direction 200A to the mated position 202. The contact 106 may move in the wiping direction 200A relative to the conductive element 108 without any lateral movement of the connectors 102, 104 relative to one another.

In one embodiment, the connector 102 includes a resilient member 324 that is coupled with the contact 106. The resilient member 324 may be joined to the contact 106 between the ends 300, 302. While the resilient member 324 is perpendicularly oriented with respect to the longitudinal axis 304, alternatively the resilient member 324 may be obliquely oriented with respect to the longitudinal axis 304. The resilient member 324 is a body that applies a force 404 (shown in FIG. 5) onto the contact 106 when the resilient member 324 is compressed. For example, the resilient member 324 may be a spring that extends between the contact 106 and an interior wall 326 in the channel 310. Compression of the resilient member 324 may impart the force 404 on the contact 106. The resilient member 324 may have an uncompressed length that extends from the contact 106 to the interior wall 326 in a perpendicular direction with respect to the longitudinal axis 304 when the contact 106 is decoupled from the conductive element 108. The resilient member 324 is compressed to a shorter compressed length when the connectors 102, 104 mate and the contact 106 laterally moves in the wiping direction 200A, as described above.

The resilient member 324 is compressed between the contact 106 and the interior wall 326 when the contact 106 moves in the wiping direction 200A from the initial position 118 (shown in FIG. 1). The movement of the contact 106 in the wiping direction 200A opposes the force 404 applied by the resilient member 324. Additionally, the force 404 may return the contact 106 to the initial position 118 when the connectors 102, 104 are decoupled from one another. For example, the resilient member 324 moves the contact 106 from the mated position 202 to the initial position 118 when the connectors 102, 104 are no longer mated.

The connector 102 may be decoupled from the connector 104 by moving the connector 102 in a direction opposite of the mating direction 110. As the connector 102 is retreated away from the connector 104 and the contact 106 is retreated away from the conductive element 108, the compressed resilient member 324 continues to apply the force 404 on the contact 106. The resilient member 324 may apply the force 404 until the resilient member 324 is no longer compressed, or until the contact 106 is returned to the initial position 118. The application of the force 404 pushes the contact 106 in a lateral direction that opposes the wiping direction 200A. For example, as the force 404 is applied to the contact 106, the interface end 302 of the contact 106 may slide down the angled interface 318 in a direction that opposes the sliding direction 400. For example, the contact 106 may slide along the angled interface 318 from the position shown in FIG. 5 to the position shown in FIG. 4. The resilient member 324 returns the contact 106 to the initial position 118 so that the side 306 may move in the sliding direction 400 along the angled interface 318 the next time the connectors 102, 104 mate to wipe the contact 106 across the conductive element 108, as described above.

Figure 7:
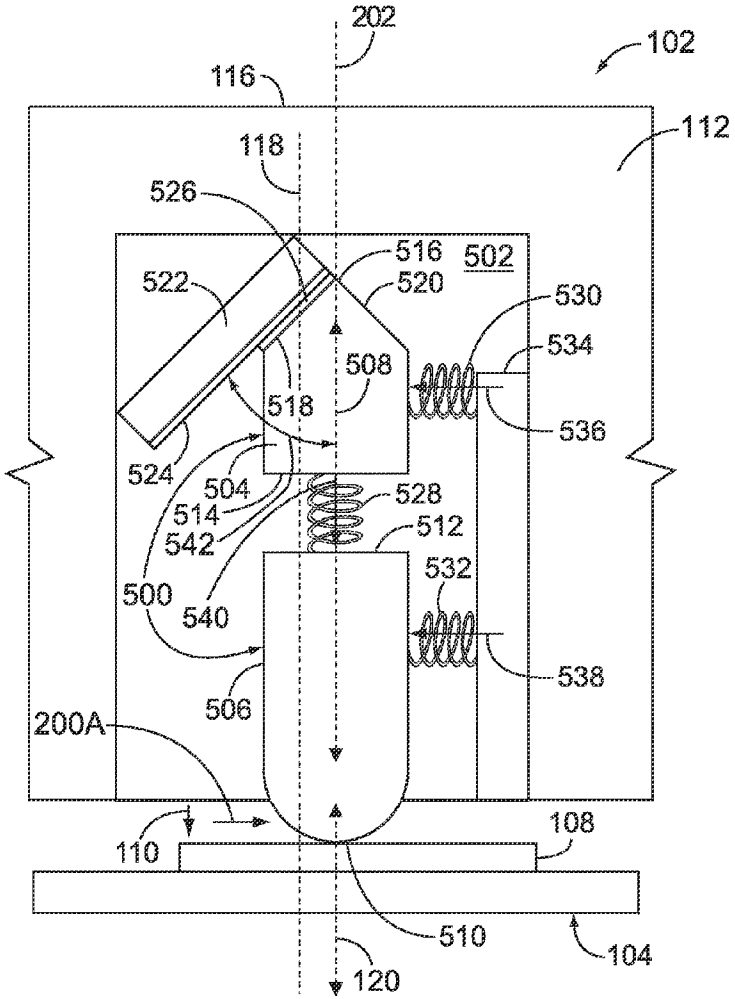
FIG. 7 is a schematic illustration of the contact shown in FIG. 6 disposed within the connector shown in FIG. 1 in a subsequent mated position in accordance with one embodiment of the present disclosure.
Figure 6:
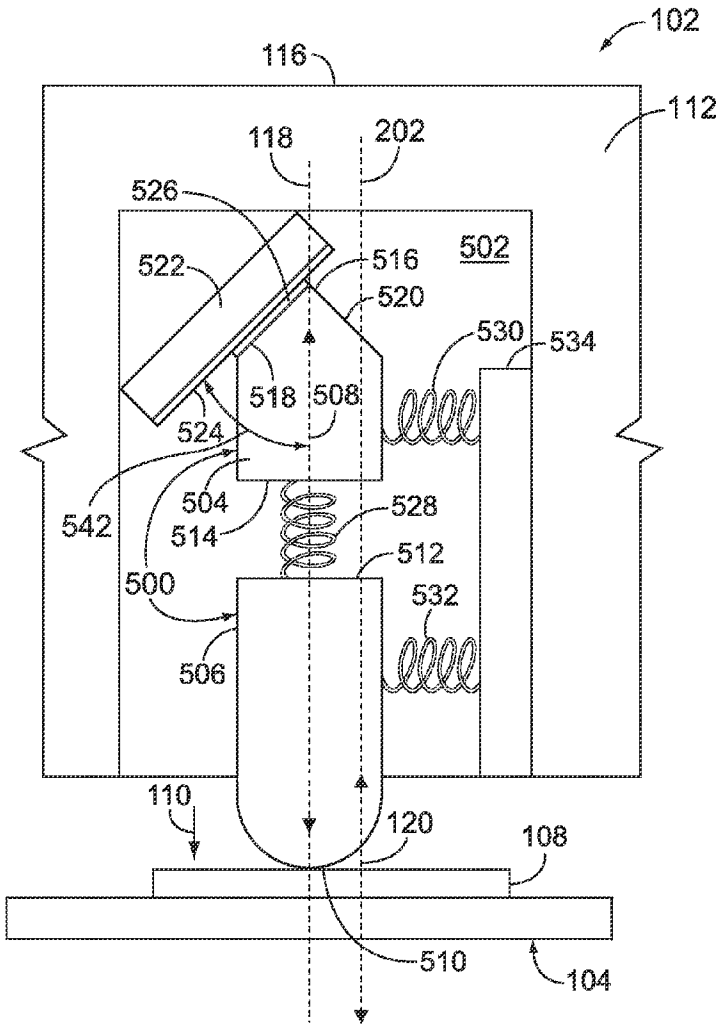
FIG. 6 is a schematic illustration of a contact disposed within the connector shown in FIG. 1 in an initial position in accordance with an alternative embodiment of the present disclosure.

FIG. 6 is a schematic illustration of a contact 500 disposed within the connector 102 in an initial position in accordance with an alternative embodiment of the present disclosure. FIG. 7 is a schematic illustration of the contact 500 disposed within the connector 102 in a subsequent mated position in accordance with one embodiment of the present disclosure. The contact 500 may be disposed within a channel 502 similar to the contact 106 (shown in FIG. 1) in the channel 310 (shown in FIG. 3). The contact 500 may be an elongated contact that is divided into multiple sections, including a sliding section 504 and a mating section 506 separated from one another by a gap. Alternatively, the contact 500 may be a non-elongated contact. While two sections 504, 506 are shown, alternatively the contact 500 may be divided into a greater number of sections. The sections 504, 506 are aligned with one another along a longitudinal axis 508 of the contact 500. The mating section 506 extends from an internal end 512 to a mating end 510 along the longitudinal axis 508. The sliding section 504 extends between another internal end 514 and an interface end 516 along the longitudinal axis 508. While the mating end 510 is shown as a rounded tip, alternatively the mating end 510 may have a different shape. Similar to the interface end 302 (shown in FIG. 4), the illustrated interface end 516 includes sides 518, 520 that are angled with respect to one another.

As shown in FIGS. 6 and 7, the channel 502 is located inside the housing 112. Similar to the channel 310 (shown in FIG. 3), the channel 502 includes an angled interface 522 that is angled with respect to the longitudinal axis 508. The angled interface 522 may include a sliding surface 524 that is obliquely oriented with respect to the longitudinal axis 508. The sliding surface 524 may be oriented at an angle 542 with respect to the longitudinal axis 508. As shown in FIGS. 6 and 7, the angle 542 is an acute angle of approximately 45 degrees. Alternatively, the angle 542 may be a different angle, such as 30 degrees. The sliding surface 524 may include or be formed from a conductive material, such as one or more metals or metal alloys. The angled interface 522 and/or sliding surface 524 may be electrically coupled with a source or recipient (not shown) of the data and/or power that is electrically communicated between the connectors 102, 104.

The angled interface 522 is slidably coupled with the interface end 516 of the contact 500. The interface end 516 may remain electrically coupled with the angled interface 522 while the interface end 516 slides along the angled interface 522. In the illustrated embodiment, the side 518 includes a coating 526 that may be similar to the coating 322 (shown in FIG. 4). Similar to the contact 106 (shown in FIG. 5), the interface end 516 of the contact 500 slides along the angled interface 522 as the connector 102 mates with the connector 104 along the mating direction 110. Prior to mating the contact 500 with the conductive element 108, the longitudinal axis 508 of the contact 500 is located at the initial position 118 that is laterally spaced apart from the center axis 120 of the conductive element 108. As the contact 500 mates with the conductive element 108 and slides along the angled interface 522, the contact 500 laterally moves across the conductive element 108 such that the longitudinal axis 508 moves toward the center axis 120 of the conductive element 108. For example, the contact 500 may move such that the longitudinal and center axes 508, 120 are aligned. Alternatively, the contact 500 may move such that the longitudinal axis 508 moves toward the center axis 120 but is not aligned with the center axis 120. The pitch of the angled interface 522 relative to the longitudinal axis 508 translates the movement of the contact 500 in the mating direction 110 to lateral movement across the conductive element 108 in the wiping direction 200A, similar to as described above.

One difference between the contacts 106 (shown in FIG. 1) and 500 is the addition of one or more additional resilient members. For example, in contrast to the contact 106, the contact 500 is coupled with an upper resilient member 530 and a lower resilient member 532. The upper resilient member 530 is coupled with the sliding section 504 of the contact 500 and extends from the sliding section 504 to an interior wall 534 that is similar to the interior wall 326 (shown in FIG. 4). The lower resilient member 532 is coupled to the mating section 506 and extends from the mating section 506 to the interior wall 534. Similar to the resilient member 324 (shown in FIG. 4), the resilient members 530, 532 are compressed between the contact 500 and the interior wall 534 when the contact 500 moves in the wiping direction 200A during mating of the connectors 102, 104. The resilient members 530, 532 impart respective forces 536, 538 on the sections 504, 506 of the contact 500 when the contact 500 moves in the wiping direction 200A. As described above, the forces 536, 538 move the contact 500 in a lateral direction oriented opposite of the wiping direction 200A when the connector 102 retreats away from and decouples from the connector 104. The inclusion of multiple resilient members 530, 532 may provide additional stability in moving the contact 500 along the wiping direction 200A. For example, the multiple resilient members 530, 532 may provide forces 536, 538 that are more evenly applied along the length of the contact 500 between the ends 510, 516.

The sections 504, 506 of the contact 500 may be interconnected by a normal resilient member 528. In the illustrated embodiment, the normal resilient member 528 is disposed within the gap between the sections 504, 506. Alternatively, the normal resilient member 528 may be located within the contact 500. For example, one of the sections 504, 506 may telescope within the other of the sections 504, 506 along the longitudinal axis 508 with the normal resilient member 528 disposed between the sections 504, 506. The normal resilient member 528 is a body that applies a force 540 on the mating section 506 when the normal resilient member 528 is compressed. For example, the normal resilient member 528 may be a spring disposed within the contact 500 between the sections 504, 506. The normal resilient member 528 may provide a force on the mating section 506 in a direction parallel to the mating direction 110 to ensure that the mating end 510 remains engaged with the conductive element 108 during mating of the connectors 102, 104. For example, after the mating end 510 engages the conductive element 108 during mating of the connectors 102, 104, movement of the connector 102 in the mating direction 110 relative to the connector 104 may displace the sections 504, 506 toward one another while also sliding the contact 500 in the wiping direction 200A. The displacement of the sections 504, 506 toward one another compresses the normal resilient member 528.

As the normal resilient member 528 is compressed, the normal resilient member 528 exerts a mating force 540 on the mating section 506 in a direction parallel to the mating direction 110 to push the mating section 506 along the mating direction 110. The mating force 540 may ensure engagement between the mating end 510 and the conductive element 108 as the contact 500 wipes across the conductive element 108 in the wiping direction 200A. For example, the mating force 540 may push the mating section 506 along the mating direction 110 to maintain contact between the mating end 510 and the conductive element 108 as the contact 500 wipes across the conductive element 108.

Figure 8:
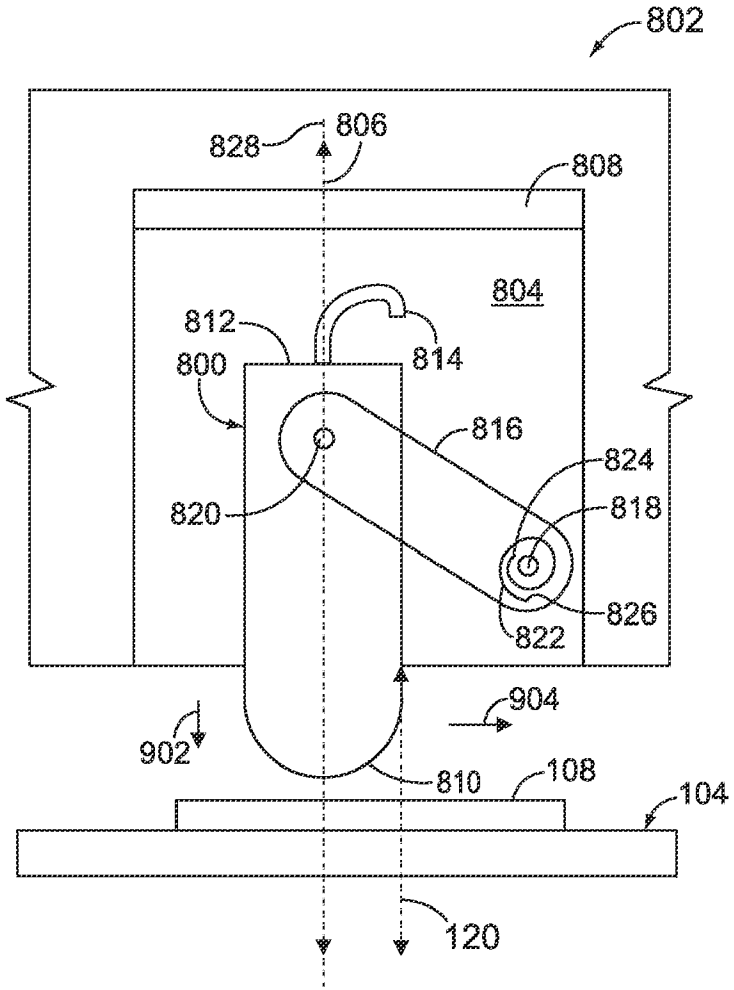
FIG. 8 is a schematic illustration of a contact in a connector in an initial position in accordance with an alternative embodiment of the present disclosure.

FIG. 8 is a schematic illustration of a contact 800 disposed within a connector 802 in an initial position in accordance with an alternative embodiment of the present disclosure. Only a portion of the connector 802 is shown. The connector 802 may be similar to the connector 102 (shown in FIG. 1) in that the connector 802 may include several channels 804 in which several contacts 800 are disposed. The connector 802 includes an interface 808 in the channel 804. The interface 808 may include or be formed from a conductive material, such as one or more metals or metal alloys. The interface 808 may be electrically coupled with a source or recipient (not shown) of the data and/or power. The contact 800 is elongated along a longitudinal axis 806. The contact 800 extends between a mating end 810 and an interface end 812. The interface end 812 includes a resilient conductive member 814. The resilient conductive member 814 may be a wire or a spring such as an elongated torsion or return spring. Alternatively, the contact 800 may have an angled side that is similar to the side 306 (shown in FIG. 4). The resilient conductive member 814 engages the interface 808 to electrically couple the contact 800 with the interface 808. As described below, the mating end 810 wipes across the conductive element 108 of the connector 104 when the connector 800 mates with the connector 104.

In the position shown in FIG. 8, the longitudinal axis 806 is located at an initial position 828 that may be similar to the initial position 118 (shown in FIG. 1) of the contacts 106 (shown in FIG. 1). The longitudinal axis 806 is laterally spaced apart from the center axis 120 of the conductive element 108 prior to mating the contact 800 with the conductive element 108. The connector 802 may include a cam 816. The cam 816 may be pivotally joined with the connector 802 by a pin 818. The cam 816 may also be connected with another pin 820 that may be joined with the contact 800. A spring 822 may be joined to the cam 816 and to the connector 802. In the illustrated embodiment, the spring 822 is joined at one end 824 to the cam 816 and to the connector 802 at an opposite end 826. The spring 822 may be a helical spring such as a compression or torsion helical spring.

The cam 816 pivots about the pin 818 when the mating end 810 of the contact 800 engages the conductive element 108. The pivoting of the cam 816 translates movement of the contact 800 and the connector 802 in the mating direction 902 into lateral movement of the contact 800 in the wiping direction 904 across the conductive element 108. The spring 822 imparts a restoring force on the cam 816 that causes the cam 816 to pivot about the pin 818 in an opposite direction when the connector 802 moves away from the connector 104. Alternatively, the resilient conductive member 814 provides the restoring force.

Figure 9:
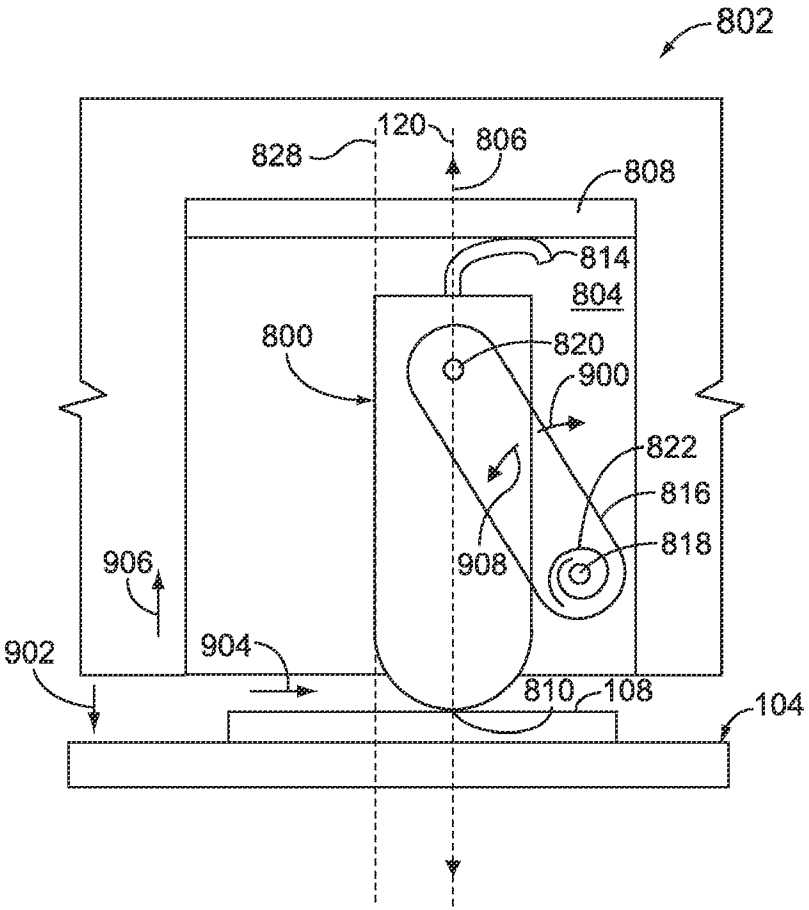
FIG. 9 is a schematic illustration of the contact shown in FIG. 8 disposed within the connector shown in FIG. 8 in a mated position.

FIG. 9 is a schematic illustration of the contact 800 disposed within the connector 802 in a mated position. During mating of the connectors 802, 104, the contact 800 is moved toward the conductive element 108 along the mating direction 902. When the mating end 810 of the contact 800 engages the conductive element 108, further movement of the contact 800 toward the conductive element 108 causes the contact 800 to move relative to the connector 802 in a direction 906 that is opposite of the mating direction 902. As the contact 800 moves in the direction 906, the cam 816 pivots about the pin 818 along an arcuate path 900. The pivoting of the cam 816 about the pin 818 causes the contact 800 to laterally move relative to the conductive element 108. For example, the fixed length of the cam 816 may cause the movement of the contact 800 in the direction 906 to be translated into movement of the contact 800 in a wiping direction 904. The contact 800 moves in the wiping direction 904 such that the longitudinal axis 806 of the contact 800 laterally moves from the initial position 828 toward the center axis 120 of the conductive element 108. The contact 800 may move such that the longitudinal and center axes 806, 120 are aligned, or may move such that the longitudinal and center axes 806, 120 are not aligned.

The lateral movement of the mating end 810 across the conductive element 108 in the wiping direction 904 may remove one or more layers of surface contamination on the conductive element 108 to improve the electrical coupling of the contact 800 with the conductive element 108. When the connector 802 is decoupled from the connector 104, the spring 822 may restore the contact 800 from the position of the contact 800 shown in FIG. 9 to the position of the contact 800 shown in FIG. 8. For example, mating the contact 800 with the conductive element 108 and pivoting the cam 816 along the arcuate path 900 may compress the spring 822 between the cam 816 and the connector 802. Moving the contact 800 away from the conductive element 108 may permit the compressed spring 822 to impart a restoring force on the cam 816. This restoring force may cause the cam 816 to pivot in an opposite direction along an opposite arcuate path 908. As the cam 816 pivots along the arcuate path 908, the contact 800 may move to the position shown in FIG. 8. While the cam 816 in the illustrated embodiment translates movement of a single contact 800 toward the conductive element 108 into lateral movement along the wiping direction 904, alternatively the cam 816 may be joined with several contacts 800 in the connector 802. The cam 816 may then translate movement of several contacts 800 toward respective conductive elements 108 into lateral movement of the contacts 800 in the wiping direction 904 to mate the contacts 800 with the conductive elements 108 while wiping the contacts 800 across the conductive elements 108.

Figure 10:
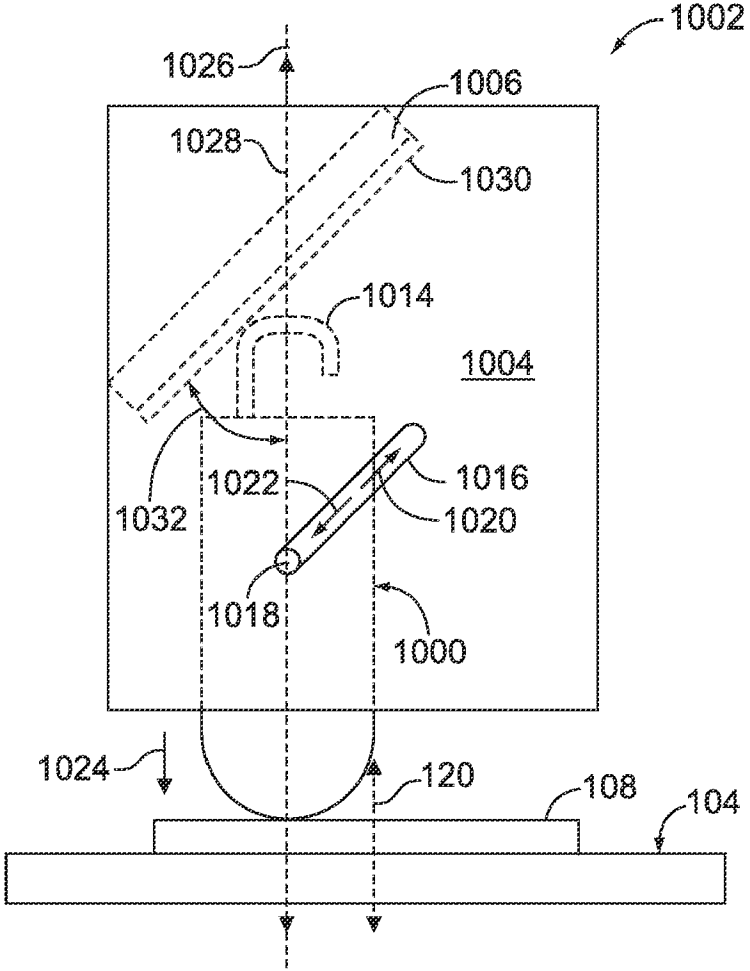
FIG. 10 is a schematic illustration of a contact disposed within a connector in an initial position in accordance with an alternative embodiment of the present disclosure.

FIG. 10 is a schematic illustration of a contact 1000 disposed within a connector 1002 in an initial position in accordance with an alternative embodiment of the present disclosure. Only a portion of the connector 1002 is shown. The connector 1002 may be similar to the connector 102 (shown in FIG. 1) in that the connector 1002 may include several channels 1004 in which several contacts 1000 are disposed. The connector 1002 includes an angled interface 1006 in the channel 1004. The angled interface 1006 may include or be formed from a conductive material, such as one or more metals or metal alloys. The angled interface 1006 may be electrically coupled with a source or recipient (not shown) of the data and/or power. The contact 1000 includes a conductive member 1014 that may be similar to the resilient conductive member 814 (shown in FIG. 8). Alternatively, the contact 1000 may have an angled side that is similar to the side 306 (shown in FIG. 4).

The contact 1000 is elongated along a longitudinal axis 1028. The angled interface 1006 may include a sliding surface 1030 that is obliquely oriented with respect to the longitudinal axis 1028. The sliding surface 1030 may be oriented at an angle 1032 with respect to the longitudinal axis 1028. As shown in FIG. 10, the angle 1032 is an acute angle of approximately 45 degrees. Alternatively, the angle 1032 may be a different angle, such as 30 degrees. The sliding surface 1030 may include or be formed from a conductive material, such as one or more metals or metal alloys. The conductive member 1014 engages the sliding surface 1030 of the angled interface 1006 to electrically couple the contact 1000 with the angled interface 1006 by way of the sliding surface 1030.

Prior to mating the contact 1000 with the conductive element 108, the longitudinal axis 1028 is in an initial position 1026 that is laterally spaced apart from the center axis 120 of the conductive element 108. As the connector 1002 moves in a mating direction 1024 toward the conductive element 108, the contact 1000 slides along the sliding surface 1030 of the angled interface 1006 to wipe across the conductive element 108, similar to as described above. The connector 1002 includes an angled slot 1016 that extends into the channel 1004. The contact 1000 includes a lateral pin 1018 that is received in the slot 1016. While the pin 1018 is described in terms of an elongated pin, alternatively the pin 1018 may be a bearing or other mechanism that reduces friction between the contact 1000 and the connector 1002 when the pin 1018 moves through the slot 1016. The pin 1018 moves within the slot 1016 to guide the contact 1000 in corresponding directions. For example, the pin 1018 may move in a first direction 1020 in the slot 1016 when the contact 1000 is moved toward the conductive element 108 to guide the contact 1000 within the channel 1004. The contact 1000 may move such that the longitudinal axis 1028 moves toward the center axis 120 of the conductive element 108. The contact 1000 may move such that the longitudinal and center axes 1028, 120 are aligned. Alternatively, the contact 1000 may move such that the longitudinal and center axes 1028, 120 are not aligned.

The pin 1018 may move in an opposite second direction 1022 in the slot 1016 when the contact 1000 is moved away from the conductive element 108 to guide the contact 1000 in the channel 1004. The movement of the pin 1018 within the slot 1016 may prevent the contact 1000 from being misaligned within the channel 1004 as the contact 1000 engages and disengages the conductive element 108. A spring or other resilient member (not shown) similar to the resilient member 324 (shown in FIG. 4) may be provided in the channel 1004 to cause contact 1000 to move along the angled interface 1006 in an opposite direction when the connector 1002 moves away from the conductive element 108.

Figure 11:
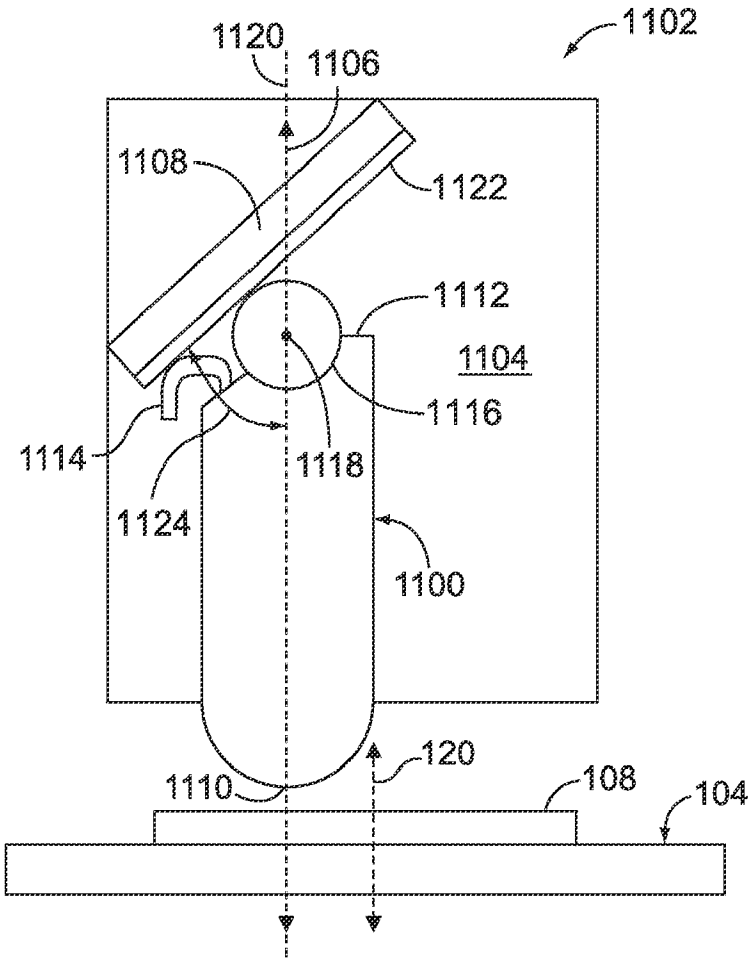
FIG. 11 is a schematic illustration of a contact disposed within a connector in an initial position in accordance with an alternative embodiment of the present disclosure.

FIG. 11 is a schematic illustration of a contact 1100 disposed within a connector 1102 in accordance with an alternative embodiment of the present disclosure. Only a portion of the connector 1102 is shown. The connector 1102 may be similar to the connector 102 (shown in FIG. 1) in that the connector 1102 may include several channels 1104 in which several contacts 1100 are disposed. The connector 1102 includes an angled interface 1108 in the channel 1104. The angled interface 1108 may include or be formed from a conductive material, such as one or more metals or metal alloys.

The angled interface 1108 may be electrically coupled with a source or recipient (not shown) of the data and/or power. The contact 1100 is elongated along a longitudinal axis 1106 between a mating end 1110 and an interface end 1112. The interface end 1112 includes a resilient conductive member 1114. The conductive member 1114 may be a wire or a spring such as an elongated torsion or return spring. The angled interface 1108 may include a sliding surface 1122 that is obliquely oriented with respect to the longitudinal axis 1106. The sliding surface 1122 may be oriented at an angle 1124 with respect to the longitudinal axis 1106. As shown in FIG. 11, the angle 1124 is an acute angle of approximately 45 degrees. Alternatively, the angle 1124 may be a different angle, such as 30 degrees. The sliding surface 1122 may include or be formed from a conductive material, such as one or more metals or metal alloys. The conductive member 1114 engages the sliding surface 1122 of the angled interface 1108 to electrically couple the contact 1100 with the angled interface 1108 by way of the sliding surface 1122.

The contact 1100 includes a rotating member 1116 disposed at or near the interface end 1112. The rotating member 1116 may be a cylindrical body that rotates about a post 1118. Alternatively, the rotating member 1116 may be a different body that rotates relative to the contact 1100. Similar to as described above, the contact 1100 moves along the sliding surface 1122 of the angled interface 1108 to translate movement of the contact 1100 toward the conductive element 108 of the connector 104 into a lateral wiping movement of the mating end 1110 across the conductive element 108.

Prior to mating the contact 1100 with the conductive element 108, the longitudinal axis 1106 is in an initial position 1120 that is laterally spaced apart from the center axis 120 of the conductive element 108. In the illustrated embodiment, the contact 1100 moves along the sliding surface 1122 of the angled interface 1108 using the rotating member 1116. The rotating member 1116 rotates about the post 1118 to roll along the sliding surface 1122. When the contact 1100 is moved toward and engages the conductive element 108, further movement of the connector 1102 toward the conductive element 108 causes the rotating member 1116 to rotate and roll along the sliding surface 1122.

The rotating member 1116 rolls along the angled interface 1108 and translates the movement of the connector 1102 toward the conductive element 108 into a lateral wiping movement of the mating end 1110 across the conductive element 108. As the rotating member 1116 rolls along the sliding surface 1122, the conductive member 1114 remains engaged with the sliding surface 1122. Alternatively, the rotating member 1116 may be conductive such that the rotating member 1116 electrically couples the contact 1100 with the sliding surface 1122 instead of, or in addition to, the conductive member 1114. For example, the conductive member 1114 may be removed or not provided such that the electrical connection between the contact 1100 and the sliding surface 1122 is provided by the rotating member 1116.

The contact 1100 laterally moves across the conductive element 108 such that the longitudinal axis 1106 of the contact 1100 moves from the initial position 1120 toward the center axis 120 of the conductive element 108. The contact 1100 may move such that the longitudinal and center axes 1106, 120 are aligned. Alternatively, the contact 1100 may move such that the longitudinal and center axes 1106, 120 are not aligned. A spring or other resilient member (not shown) similar to the resilient member 324 (shown in FIG. 4) may be provided in the channel 1104 to cause the rotating member 1116 to roll along the sliding surface 1122 in an opposite direction when the connector 1102 moves away from the conductive element 108.

Figure 12:
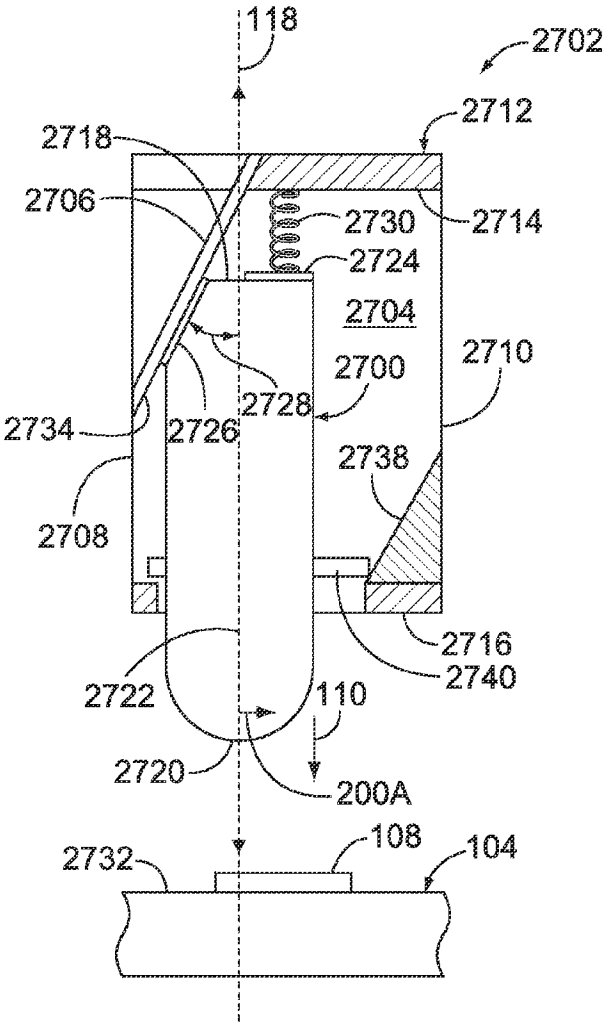
FIG. 12 is a schematic illustration of a contact in an initial position within a connector in accordance with an alternative embodiment of the present disclosure.

FIG. 12 is a schematic illustration of a contact 2700 in an initial position within a connector 2702 in accordance with an alternative embodiment of the present disclosure. Only a portion of the connector 2702 is shown. The connector 2702 may be similar to the connector 102 (shown in FIG. 1) in that the connector 2702 may include several channels 2704 in a housing 2712. The connector 2702 includes an angled interface 2706 in the channel 2704. The angled interface 2706 may include or be formed from a conductive material, such as one or more metals or metal alloys. The channel 2704 is at least partially bounded by opposing end walls 2708, 2710 and an interconnecting wall 2714. A front end 2716 of the housing 2712 opposes the interconnecting wall 2714. The front end 2716 may be open to permit the contact 2700 to mate with the conductive element 108 of the connector 104.

The angled interface 2706 may include a sliding surface 2734 that is obliquely oriented with respect to the longitudinal axis 2722 of the contact 2700. The sliding surface 2734 may be oriented at the angle 2728 with respect to the longitudinal axis 2722. The angle 2728 may be smaller than the angles 328, 542, 1032, 1124 between the sliding surfaces 320, 524, 1030, 1122 and the longitudinal axes 304, 508, 1028, 1106 of the contacts 106, 500, 1000, 1100, as shown in FIGS. 4, 5, 6, 7, 10, and 11. For example, the angle 2728 may be 30 degrees or less while the angles 328, 542, 1032, 1124 are greater than 30 degrees. The angled interface 2706 and/or the sliding surface 2734 may be electrically coupled with a source or recipient (not shown) of the data and/or power that is electrically communicated between the connectors 2702, 104. For example, the sliding surface 2734 may be a contact pad similar to the conductive element 108 that receives data signals communicated from the connector 104 to the connector 2702.

In the illustrated embodiment, the connector 2702 includes an opposing angled wall 2738 in the channel 2704 and the contact 2700 includes a guidance shoulder 2740 that protrudes from the contact 2700. The guidance shoulder 2740 may be a collar that projects from the contact 2700. The guidance shoulder 2740 engages the angled wall 2738 when the contact 2700 mates with the conductive element 108 in order to help keep the contact 2700 oriented in the channel 2704. For example, the engagement between the guidance shoulder 2740 and the angled wall 2738 may keep the longitudinal axis 2722 of the contact 2700 oriented perpendicular to the upper surface 2732 of the connector 104 when the contact 2700 laterally moves within the channel 2704.

The contact 2700 may be an elongated contact that extends from an interface end 2718 to a mating end 2720 along a longitudinal axis 2722. Alternatively, the contact 2700 may be a non-elongated contact. While the mating end 2720 is shown as a rounded tip, alternatively the mating end 2720 may have a different shape. The contact 2700 is shown in an initial unmated position in FIG. 12. In this position, the longitudinal axis 2722 is aligned with the initial position 118. The illustrated interface end 2718 includes an attachment area 2724 that may be formed from or include a conductive material, such as a metal or metal alloy. The attachment area 2724 may be a low friction area. For example, the attachment area 2724 may have a relatively low coefficient of friction. An angled side 2726 of the contact 2700 merges into the interface end 2718. The angled side 2726 is oriented at an acute angle 2728 with respect to the longitudinal axis 2722 of the contact 2700.

A resilient member 2730 is disposed between the attachment area 2724 and the interconnecting wall 2714. In the illustrated embodiment, the resilient member 2730 is disposed on the right side of the longitudinal axis 2722 of the contact 2700. For example, the resilient member 2730 and the angled side 2726 may be located on an opposite sides of the longitudinal axis 2722. The resilient member 2730 may be a compression spring or polymer that can be compressed between the interconnecting wall 2714 and the attachment area 2724. In one embodiment, the resilient member 2730 is slightly compressed even when the contact 2700 is unmated from the conductive element 108. Continual compression of the resilient member 2730 may impart a force on the attachment area 2724 of the contact 2700 that keeps the longitudinal axis 2722 of the contact 2700 perpendicular to an upper surface 2732 of the connector 104, such as an upper surface of the printed circuit board to which the conductive element 108 is mounted or joined.

The angled side 2726 of the contact 2700 is slidably coupled with the sliding surface 2734 of the connector 2702. For example, the angled side 2726 may slide along the sliding surface 2734. The angled side 2726 may remain electrically coupled with the sliding surface 2734 while the angled side 2726 slides along the sliding surface 2734. The angled side 2726 of the contact 2700 slides along the sliding surface 2734 as the connector 2702 moves relative to the connector 104 in the mating direction 110 to mate with the connector 104. For example, the connector 2702 is moved toward the connector 104 and/or the connector 104 is moved toward the connector 2702 until the mating end 2720 of the contact 2700 engages the conductive element 108 of the connector 104. Further movement of the connector 2702 toward the connector 104 and/or the connector 104 toward the connector 2702 causes the angled side 2726 of the contact 2700 to slide upward along the sliding surface 2734. As the angled side 2726 of the contact 2700 slides up along the sliding surface 2734, the resilient member 2730 is compressed between the attachment area 2724 and the interconnecting wall 2714 and the contact 2700 moves in the wiping direction 200A. Alternatively, the angled side 2726 of the contact 2700 may slide along the sliding surface 2734 to move in the wiping direction 200B (shown in FIG. 2).

The resilient member 2730 may be fixed to the interconnecting wall 2714 and may slide along the attachment area 2724 when the angled side 2726 of the contact 2700 moves along the sliding surface 2734. As described above, the attachment area 2724 may be a relatively low friction surface that allows the resilient member 2730 to remain fixed to the interconnecting wall 2714 while sliding along the attachment area 2724 during movement of the contact 2700 in the channel 2704.

Figure 13:
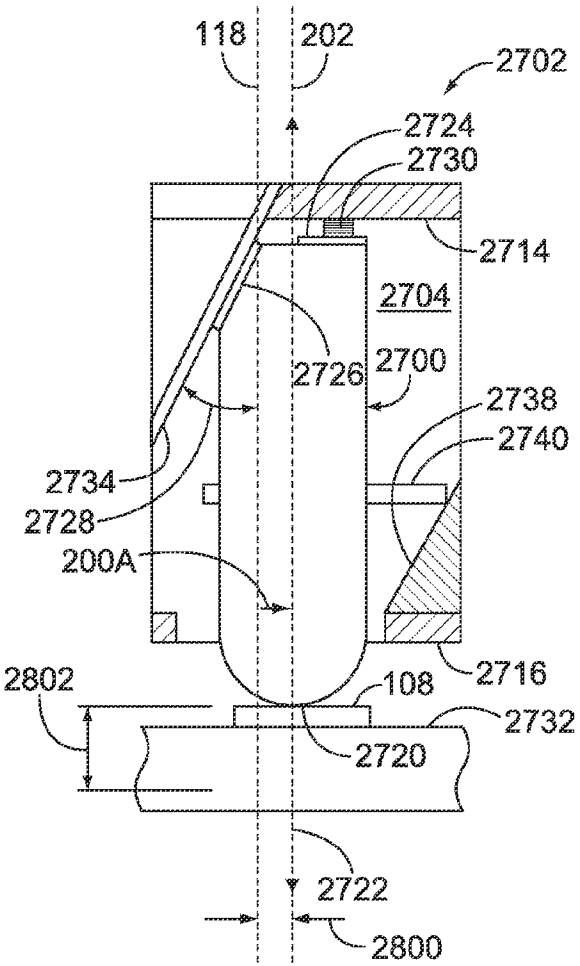
FIG. 13 is a schematic illustration of the contact (shown in FIG. 12) of the connector (shown in FIG. 12) in a mated position in accordance with one embodiment of the present disclosure.

FIG. 13 is a schematic illustration of the contact 2700 of the connector 2702 in a mated position in accordance with one embodiment of the present disclosure. As the connector 2702 and/or the connector 104 are moved toward each other, the angled side 2726 of the contact 2700 slides along the sliding surface 2734. The angled side 2726 of the contact 2700 slides such that the longitudinal axis 2722 of the contact 2700 moves from the initial position 118 to the mated position 202. For example, the movement of the connector 2702 and contact 2700 toward the connector 104 (and/or the movement of the connector 104 toward the connector 2702) is translated into lateral movement of the contact 2700 in the wiping direction 200A by the angled side 2726 of the contact 2700 sliding along the sliding surface 2734.

As the contact 2700 moves within the channel 2704 in the wiping direction 200A, the resilient member 2730 is compressed between the interconnecting wall 2714 and the attachment area 2724. The resilient member 2730 is located on the side of the longitudinal axis 2722 that is opposite of the angled side 2726. The resilient member 2730 imparts a force on the contact 2700 when the angled side 2726 of the contact 2700 slides along the sliding surface 2734. When the mating end 2720 of the contact 2700 engages the conductive element 108 and the resilient member 2730 is compressed between the interconnecting wall 2714 and the attachment area 2724 of the contact 2700, the contact 2700 is prevented from rotating in a clockwise direction within the channel 2704 by three points of engagement with the contact 2700. The three points of engagement shown in FIG. 13 include the engagement between the resilient member 2730 and the attachment area 2724 of the contact 2700, the engagement between the angled side 2726 of the contact 2700 and the sliding surface 2734, and the engagement between the mating end 2720 of the contact 2700 and the conductive element 108. When the connectors 2702, 104 are then moved away from each other to decouple the connectors 2702, 104, the resilient member 2730 may push the contact 2700 such that the contact 2700 slides along the sliding surface 2734 and the longitudinal axis 2722 returns to the initial position 118. For example, the resilient member 2730 may impart a force on the contact 2700 that drives the angled side 2726 of the contact 2700 along the sliding surface 2734 until the longitudinal axis 2722 of the contact 2700 is aligned with or near the initial position 118.

The contact 2700 moves in the wiping direction 200A by a lateral distance 2800 when the contact 2700 mates with the conductive element 108 and slides along the sliding surface 2734. The lateral distance 2800 represents the distance between the initial position 118 and the mated position 202. For example, the lateral distance 2800 may be the distance that the longitudinal axis 2722 moves when the contact 2700 wipes across the conductive element 108. The guidance shoulder 2740 may engage the angled wall 2738 as the contact 2700 moves in the wiping direction 200A in order to keep the longitudinal axis 2722 of the contact 2700 approximately perpendicular to the upper surface 2732 of the connector 104. For example, the guidance shoulder 2740 may slide along the angled wall 2738 and keep the longitudinal axis 2722 parallel to the orientation of the longitudinal axis 2722 when the longitudinal axis 2722 was located at the initial position 118.

The contact 2700 also inwardly moves into the channel 2704 when the contact 2700 mates with the conductive element 108 and slides along the sliding surface 2734. The contact 2700 moves into the channel 2704 by a vertical distance 2802. The vertical distance 2802 may be measured in a direction that is perpendicular to the wiping direction 200A. The vertical distance 2802 is the distance that the mating end 2720 moves toward the front end 2716 in the illustrated embodiment. The vertical distance 2802 also may represent the distance that the resilient member 2730 is compressed between the attachment area 2724 of the contact 2700 and the interconnecting wall 2714.

In the illustrated embodiment, the vertical distance 2802 that the contact 2700 moves into the channel 2704 is greater than the lateral distance 2800 that the contact 2700 moves in the wiping direction 200A. The angle 2728 between the sliding surface 2734 and the longitudinal axis 2722 of the contact 2700 may be sufficiently small that the contact 2700 moves farther into the channel 2704 than the contact 2700 moves in the wiping direction 200A. For example, the lateral distance 2800 that the contact 2700 moves across the conductive element 108 may be relatively small in proportion to the vertical distance 2802 that the contact 2700 recedes into the channel 2704 and/or the resilient member 2730 is compressed.

Figure 14:
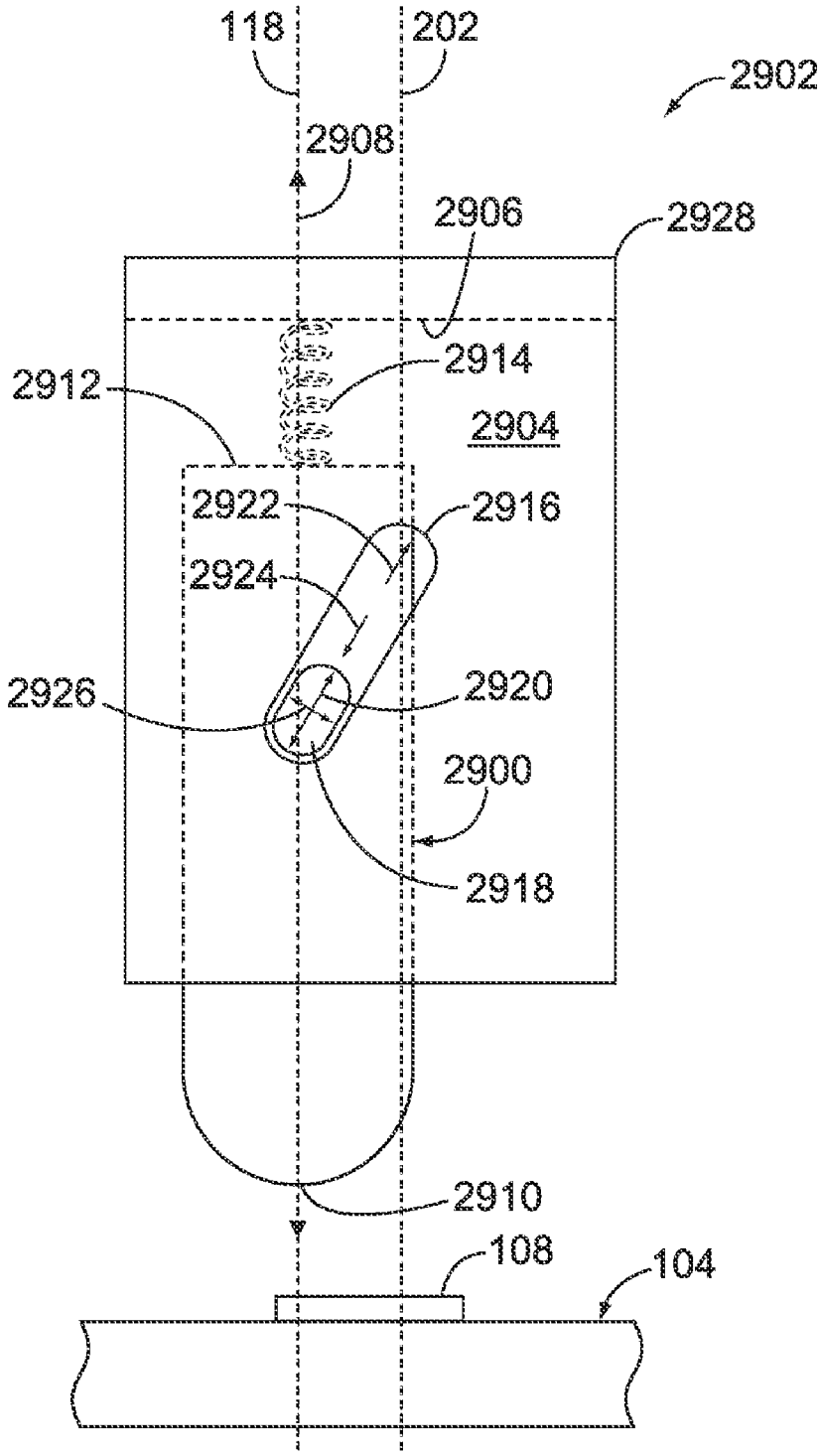
FIG. 14 is a schematic illustration of a contact disposed within a connector in an initial position in accordance with an alternative embodiment of the present disclosure.

FIG. 14 is a schematic illustration of a contact 2900 disposed within a connector 2902 in an initial position 118 in accordance with an alternative embodiment of the present disclosure. Only a portion of the connector 2902 is shown. The connector 2902 may be similar to the connector 102 (shown in FIG. 1) in that the connector 2902 may include a housing 2928 having several channels 2904 in which several contacts 2900 are disposed. The connector 2902 includes a conductive interface 2906 in the channel 2904. The conductive interface 2906 may include or be formed from a conductive material, such as one or more metals or metal alloys. The conductive interface 2906 may be electrically coupled with a source or recipient (not shown) of the data and/or power. In one embodiment, the housing 2928 includes or is formed from a conductive material that is electrically coupled with the source or recipient of the data and/or power by way of the conductive interface 2906. Alternatively, the housing 2928 may be electrically coupled with the source or recipient of the data and/or power without the data and/or power being conveyed through the conductive interface 2906.

The contact 2900 may be elongated along a longitudinal axis 2908 between a mating end 2910 and an interface end 2912. Alternatively, the contact 2900 may be a non-elongated contact. A resilient member 2914 is disposed between the conductive interface 2906 of the connector 2902 and the interface end 2912 of the contact 2900. The resilient member 2914 may be a conductive spring or a conductive polymer. The resilient member 2914 may electrically couple the contact 2900 with the conductive interface 2906.

The connector 2902 includes an angled slot 2916 that extends into the channel 2904. The contact 2900 includes a lateral pin 2918 that protrudes from the contact 2900 and is received in the slot 2916. The pin 2918 may be a conductive body that is electrically coupled with the housing 2928. For example, data signals and/or power may be conveyed between the contact 2900 and the housing 2928 by way of the interface between the pin 2918 and the housing 2928 in the angled slot 2916. While the pin 2918 is described in terms of an elongated pin, alternatively the pin 2918 may be a bearing or other mechanism that reduces friction between the contact 2900 and the connector 2902 when the pin 2918 moves in the slot 2916. In the illustrated embodiment, the pin 2918 has an oblong cross-sectional area. For example, as shown in FIG. 14, the cross-section of the pin 2918 is elongated along a primary direction 2920 by a distance that is greater than the distance that the pin 2918 extends along a perpendicular secondary direction 2926. While the pin 2918 is shown as having rounded sides in the illustrated embodiment, alternatively the pin 2918 may have flat sides. For example, the cross-sectional area of the pin 2918 may have a shape of a parallelogram as opposed to the oval shape in FIG. 14.

Prior to mating the contact 2900 with the conductive element 108 of the connector 104, the longitudinal axis 2908 is in the initial position 118. As the connector 2902 moves toward the connector 104 and/or the connector 104 moves toward the connector 2902, the mating end 2910 of the contact 2900 engages the conductive element 108. Continued movement of the connector 2902 toward the connector 104 and/or the connector 104 toward the connector 2902 causes the contact 2900 to be inwardly moved into the channel 2904.

Inward movement of the contact 2900 causes the pin 2918 to move within the slot 2916. The pin 2918 is an angled interface to the contact 2900 that translates movement of the connector 2902 toward the connector 104 (and/or movement of the connector 104 toward the connector 2902) into lateral movement of the contact 2900. The pin 2918 moves with the contact 2900 and within the slot 2916 to guide the contact 2900 in corresponding directions. For example, the pin 2918 may move in a first direction 2922 in the slot 2916 when the contact 2900 is forced inward by engagement with the conductive element 108. The contact 2900 is guided by movement of the pin 2918 in the slot 2916 such that the longitudinal axis 2908 of the contact 2900 moves from the initial position 118 toward the mated position 202. As the contact 2900 moves inward, the resilient member 2914 is compressed between the conductive interface 2906 and the interface end 2912 of the contact 2900. The oblong shape of the pin 2918 may prevent the pin 2918 from rotating within the slot 2916. For example, the oblong shape of the cross-sectional area of the pin 2918 may prevent the contact 2900 from rotating about the pin 2918. Otherwise, rotation of the contact 2900 about the pin 2918 may cause the longitudinal axis 2908 of the contact 2900 to become obliquely oriented with respect to the longitudinal axis 2908 in the initial position 118 as the contact 2900 moves in the channel 2904.

The pin 2918 may move in an opposite second direction 2924 in the slot 2916 when the contact 2900 is moved away from the conductive element 108 to guide the contact 2900 in the channel 2904 from the mated position 202 to the initial position 118. For example, the compressed resilient member 2914 may impart a force on the contact 2900 that moves the contact 2900 in the channel 2904 such that the pin 2918 moves in the second direction 2924 within the slot 2916. The movement of the pin 2918 in the slot 2916 translates movement of the connector 2902 away from the connector 104 and/or movement of the connector 104 away from the connector 2902 into lateral movement of the contact 2900 from the mated position 202 to the initial position 118.

Figure 15:
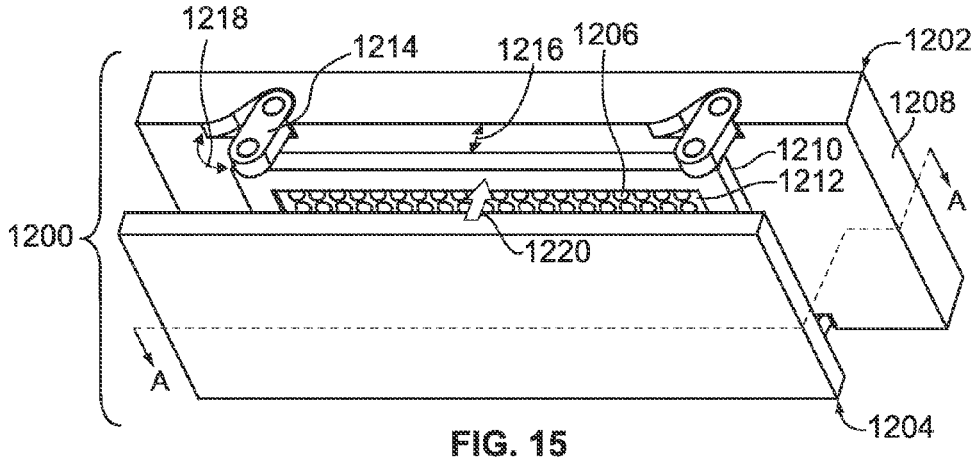
FIG. 15 is a perspective view of a connector system in accordance with another embodiment.

FIG. 15 is a perspective view of a connector system 1200 in accordance with another embodiment. The connector system 1200 includes first and second connectors 1202, 1204 that mate with each other. The connectors 1202, 1204 include contacts 1206, 1304 (shown in FIG. 16) that engage each other when the connectors 1202, 1204 mate to electrically communicate data and/or power between the connectors 1202, 1204. The first connector 1202 includes a body 1208 that is coupled with a mating array 1210. The body 1208 may be a housing of an electronic device that uses the contacts 1206 to electrically communicate data and/or power with the connector 1204. The mating array 1210 includes an approximately planar substrate 1212 with the contacts 1206 joined to or supported by the substrate 1212. The planar substrate 1212 may be a printed circuit board. For example, the planar substrate 1212 may be a printed circuit board having the contacts 1206 mounted to or part of the printed circuit board. The planar substrate 1212 may include or be adjacent to a flexible or compressive backing material (not shown). Such a backing material may permit the planar substrate 1212 to align itself with the second connector 1204 in order to account for any misalignment between the planar substrate 1212 and the second connector 1204. For example, if the planar substrate 1212 and the second connector 1204 are not co-planar, the backing material may permit the planar substrate 1212 to move such that the planar substrate 1212 is co-planar with the second connector 1204. In the illustrated embodiment, the second connector 1204 is a circuit board, such as a printed circuit board. Alternatively, the second connector 1204 may be a different device or assembly that includes the contacts 1304 that mate with the contacts 1206 of the first connector 1202.

Several rotating arms 1214 join the mating array 1210 to the body 1208. In the illustrated embodiment, the arms 1214 are four elongated arms located at the corners of the mating array 1210. Alternatively, a different number of arms 1214 may be provided and/or the arms 1214 may be joined elsewhere to the mating array 1210. The rotating arms 1214 separate the mating array 1210 from the body 1208 such that a gap 1216 exists between the body 1208 and the mating array 1210. The arms 1214 rotate along respective arcs 1218 to move the mating array 1210 closer to or farther from the body 1208. For example, the arms 1214 may rotate toward the body 1208 to move the mating array 1210 toward the body 1208 and reduce the size of the gap 1216 between the body 1208 and the mating array 1210. Conversely, the arms 1214 may rotate away from the body 1208 to move the mating array 1210 away from the body 1208 and increase the size of the gap 1216. In one embodiment, the arms 1214 include or are coupled with resilient bodies (not shown), such as springs, that are compressed when the arms 1214 rotate toward the body 1208. For example, the arms 1214 may include or be joined with torsion springs that are loaded when a compressive force 1220 is applied to the mating array 1210 in a direction toward the body 1208. The compressive force 1220 causes the mating array 1210 to move toward the body 1208 and the arms 1214 to rotate toward the body 1208. The loaded torsion springs apply a resistive force on the arms 1214 in an opposite direction of the compressive force 1220. The resistive force rotates the arms 1214 away from the body 1208 and moves the mating array 1210 away from the body 1208 when the compressive force 1220 is removed or sufficiently reduced. For example, the resilient bodies of the arms 1214 may keep the mating array 1210 separated from the body 1208 when the first and second connectors 1202, 1204 are not mated with each other.

Figure 16:
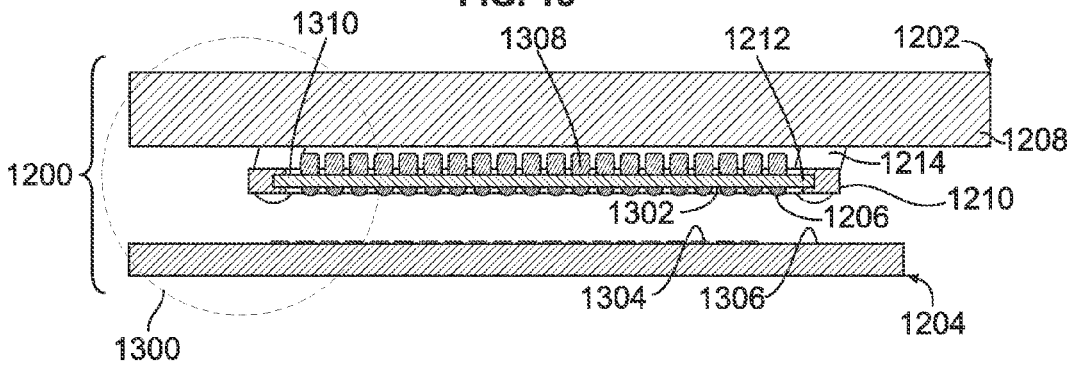
FIG. 16 is a cross-sectional view of the connector system shown in FIG. 15 in an unmated state along line A-A in FIG. 15.
Figure 17:
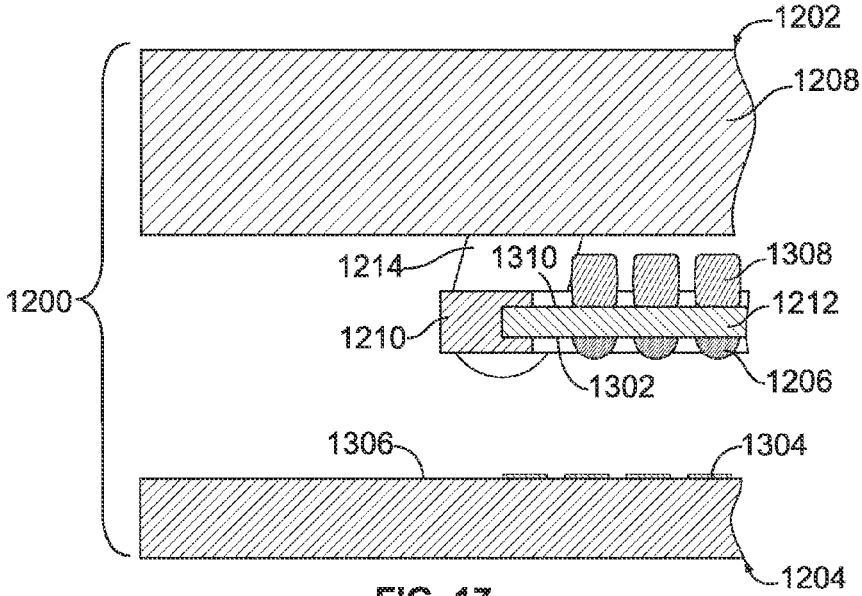
FIG. 17 is a detail view of a portion of the connector system shown in FIG. 16.

FIG. 16 is a cross-sectional view of the connector system 1200 in an unmated state along line A-A in FIG. 15. FIG. 17 is a detail view of a portion 1300 of the connector system 1200 shown in FIG. 16. The connectors 1202, 1204 are shown in FIGS. 13 and 14 as being separated from one another in an unmated state. In the illustrated embodiment, the contacts 1206 of the first connector 1202 are coupled with the substrate 1212 of the mating array 1210. In one embodiment, the substrate 1212 is a flexible member that may bend or flex in response to forces that are applied to the contacts 1206 and/or substrate 1212. The substrate 1212 may be flexible in order to permit the contacts 1206 to mate with irregular or non-planar mating surfaces. The contacts 1206 are presented on a mating side 1302 of the substrate 1212. As described above, the contacts 1206 engage pairing contacts 1304 on a surface 1306 of the second connector 1204. The contacts 1304 of the second connector 1204 may be substantially flat conductive elements, such as conductive pads formed on the surface 1306.

The mating array 1210 includes several resilient members 1308 presented on the opposite side 1310 of the substrate 1212. For example, the resilient members 1308 may be mounted to the side 1310 of the substrate 1212 that is opposite of the mating side 1302. In the illustrated embodiment, one resilient member 1308 is provided for each contact 1206 of the mating array 1210. Alternatively, one resilient member 1308 may be provided for several contacts 1206 or more than one resilient member 1308 may be provided for each contact 1206. In another embodiment, a single resilient member 1308, such as a sheet of resilient material, may be disposed on the opposite side 1310 of the substrate 1212.

The resilient members 1308 are bodies that are capable of being compressed between the mating array 1210 and the body 1208 when the connectors 1202, 1204 mate with each other and the mating array 1210 is moved toward the body 1208 of the first connector 1202. For example, in the illustrated embodiment, the resilient members 1308 include or are formed from a polymer that can be compressed. Alternatively, the resilient members 1308 may be springs that are compressed between the mating array 1210 and the body 1208. In another example, the resilient members 1308 may be spring fingers that are compressed between the mating array 1210 and the body 1208. Other alternative forms and compositions of the resilient members 1308 may be used.

Figure 18:
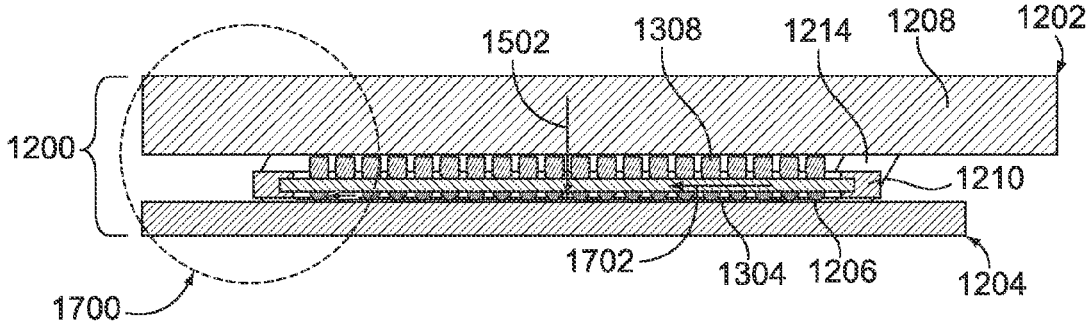
FIG. 18 is a cross-sectional view of the connector system shown in FIG. 15 in a partially mated state along line A-A in FIG. 15.
Figure 19:
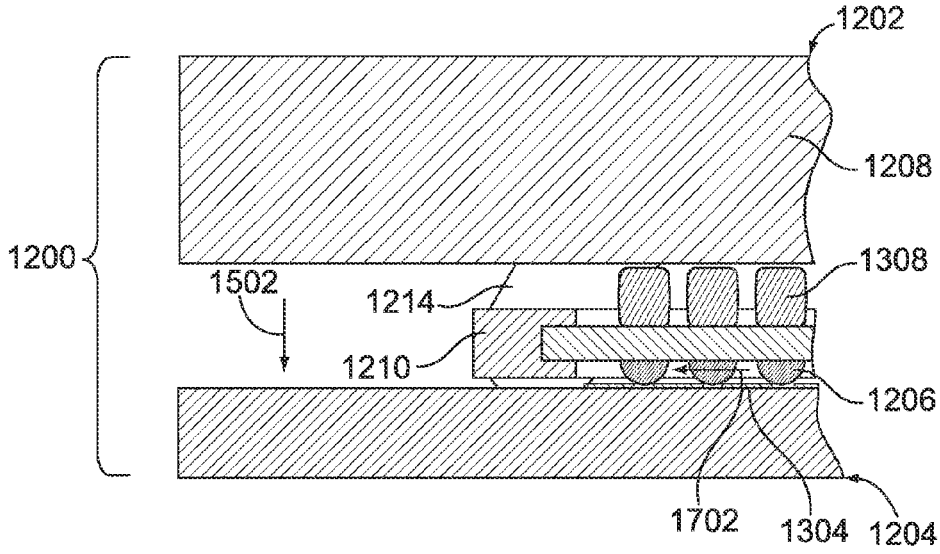
FIG. 19 is a detail view of a portion of the connector system shown in FIG. 18.

FIG. 18 is a cross-sectional view of the connector system 1200 in a partially mated state along line A-A in FIG. 15. FIG. 19 is a detail view of a portion 1700 of the connector system 1200 shown in FIG. 18. The first connector 1202 mates with the second connector 1204 by moving the first and/or second connectors 1202, 1204 toward each other. The connectors 1202, 1204 may be moved such that the first connector 1202 moves relative to the second connector 1204 along the mating direction 1502. Once the contacts 1206 of the first connector 1202 engage the contacts 1304 of the second connector 1204, further movement of the first connector 1202 relative to the second connector 1204 in the mating direction 1502 causes the mating array 1210 to be pushed toward the body 1208 of the first connector 1202.

As the mating array 1210 moves toward the body 1208, the arms 1214 rotate toward the body 1208. The rotation of the arms 1214 toward the body 1208 causes the mating array 1210 and the contacts 1206 of the first connector 1202 to move in a wiping direction 1702 relative to the contacts 1304 of the second connector 1204. As shown in FIGS. 15 and 16, the mating direction 1502 in which the first connector 1202 moves relative to the second connector 1204 is approximately perpendicular to the lateral wiping direction 1702 in which the contacts 1206 of the first connector 1202 move relative to the contacts 1304 of the second connector 1204. In the illustrated embodiment, the contacts 1206 are moving relative to the contacts 1304 in the wiping direction 1702.

Figure 20:
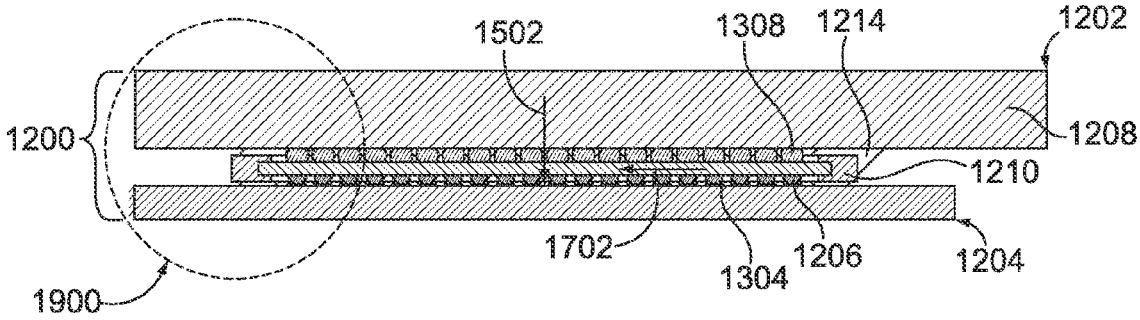
FIG. 20 is a cross-sectional view of the connector system shown in FIG. 15 in a mated state along line A-A in FIG. 15.
Figure 21:
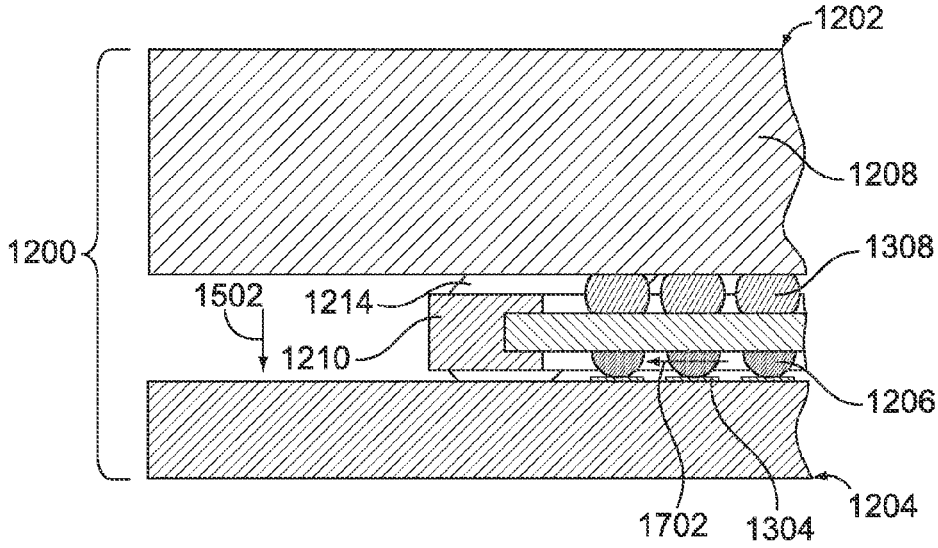
FIG. 21 is a detail view of a portion of the connector system shown in FIG. 20.

FIG. 20 is a cross-sectional view of the connector system 1200 in a mated state along line A-A in FIG. 15. FIG. 21 is a detail view of a portion 1900 of the connector system 1200 shown in FIG. 20. The connectors 1202, 1204 are shown mated with each other in FIGS. 17 and 18. As described above, movement of the first connector 1202 along the mating direction 1502 relative to the second connector 1204 causes the mating array 1210 and the contacts 1206 of the first connector 1202 to wipe across the contacts 1304 of the second connector 1204 in the wiping direction 1702. The lateral movement of the contacts 1206 across the contacts 1304 may remove one or more layers of surface contamination on the contacts 1304 such that the contacts 1206, 1304 are electrically coupled with one another. The contacts 1206 may wipe across the contacts 1304 such that the electrical connection between the contacts 1206 and the contacts 1304 is improved over contacts 1206 that do not wipe across the contacts 1304.

As shown in FIGS. 17 and 18, the resilient members 1308 may be compressed between the mating array 1210 and the body 1208 of the first connector 1202. Compression of the resilient members 1308 may provide increased tolerance in the location of the mating array 1210 such that the mating array 1210 may be moved toward the body 1208 to wipe the contacts 1206 across the contact 1304 while avoiding bottoming out or abutting the body 1208. The resilient members 1308 may account for undulations and uneven locations of the contacts 1304 relative to the contacts 1206.

As described above, the arms 1214 may include or be coupled with resilient bodies such as springs that cause the arms 1214 to rotate away from the body 1208 and the mating array 1210 to move away from the body 1208 when the first and second connectors 1202, 1204 move away from each other. For example, the mating array 1210 may return to the position shown in FIGS. 13 and 14 when the first and second connectors 1202, 1204 are moved away from each other.

Figure 22:
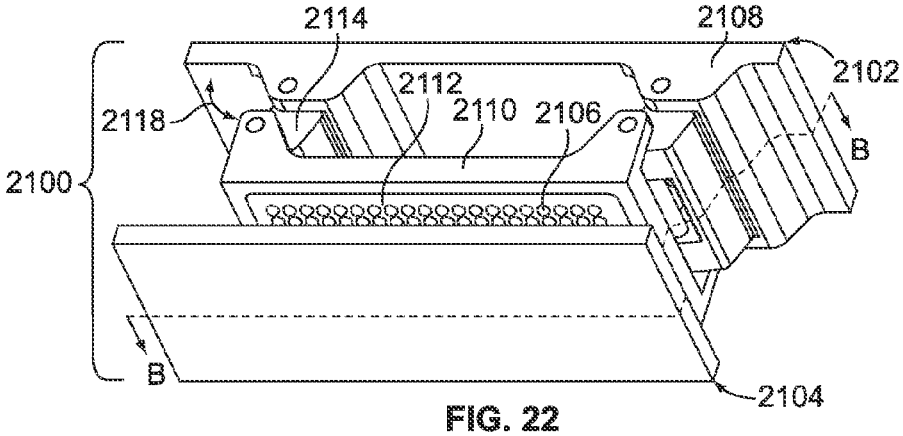
FIG. 22 is a perspective view of a connector system in accordance with another embodiment.

FIG. 22 is a perspective view of a connector system 2100 in accordance with another embodiment. The connector system 2100 includes first and second connectors 2102, 2104 that mate with each other. The connector 2104 may be referred to as a mating connector. Similar to the connector system 1200 (shown in FIG. 15), the connectors 2102, 2104 include contacts 2106, 2204 (shown in FIG. 23) that engage each other when the connectors 2102, 2104 mate to electrically communicate data and/or power between the connectors 2102, 2104. The first connector 2102 includes a body 2108 that is coupled with a mating array 2110. Similar to the body 1208 (shown in FIG. 15), the body 2108 may be a housing of an electronic device. The mating array 2110 includes an approximately planar substrate 2112 with the contacts 2106 joined to the substrate 2112. The second connector 2104 may be a circuit board or other device or assembly that includes the contacts 2204 that mate with the contacts 2106 of the first connector 2102.

The first connector 2102 includes rotating arms 2114 that join the mating array 2110 to the body 2108. In the illustrated embodiment, the rotating arms 2114 are two hinge elements that are joined to opposite sides of the mating array 2110. Alternatively, a different number of rotating arms 2114 may be provided and/or the rotating arms 2114 may be joined to the mating array 2110 in different locations. The rotating arms 2114 separate the mating array 2110 from the body 2108. The rotating arms 2114 rotate along respective arcs 2118 to move the mating array 2110 closer to or farther from the body 2108, similar to as described above in connection with the arms 1214 of the first connector 1202 shown in FIG. 15.

Figure 23:
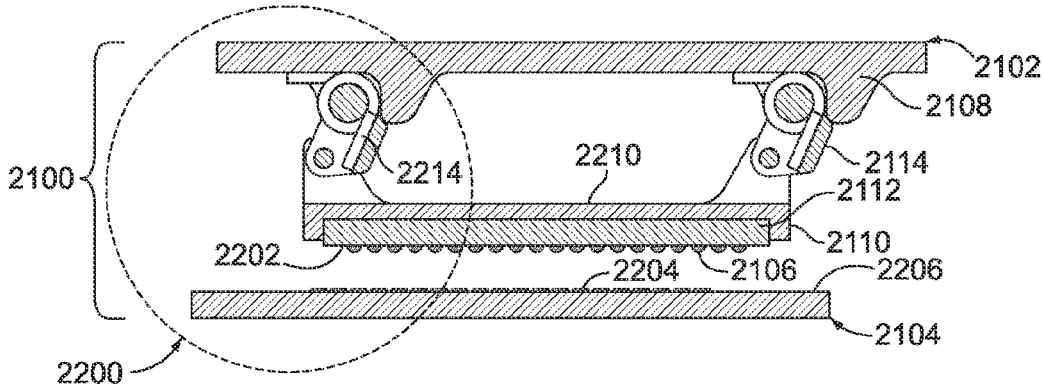
FIG. 23 is a cross-sectional view of the connector system shown in FIG. 22 in an unmated state along line B-B in FIG. 22.
Figure 24:
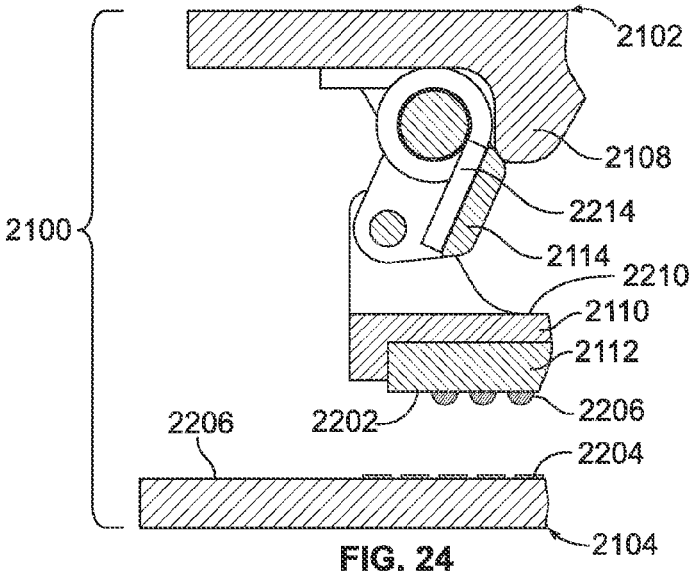
FIG. 24 is a detail view of a portion of the connector system shown in FIG. 23.

FIG. 23 is a cross-sectional view of the connector system 2100 in an unmated state along line B-B in FIG. 22. FIG. 24 is a detail view of a portion 2200 of the connector system 2100 shown in FIG. 23. In one embodiment, the substrate 2112 is a flexible member that may bend or flex in response to forces that are applied to the contacts 2106 and/or substrate 2112.

The contacts 2106 are presented on a mating side 2202 of the mating array 2110. The contacts 2106 engage pairing contacts 2204 on a surface 2206 of the second connector 2104. The contacts 2204 of the second connector 2104 may be similar to the contacts 1304 (shown in FIG. 15) of the second connector 1204 (shown in FIG. 15). The mating array 2110 includes an opposite side 2210 that faces the body 2108 of the first connector 2102.

In the illustrated embodiment, resilient bodies 2214 are disposed within the rotating arms 2114. The resilient bodies 2214 shown in FIGS. 20 and 21 are torsion springs, but alternatively may be a different resilient body. The resilient bodies 2214 are compressed when the rotating arms 2114 rotate toward the body 2108. For example, the resilient bodies 2214 may be compressed when the mating array 2110 engages the second connector 2104 and is forced toward the body 2108. As the mating array 2110 is moved toward the body 2108, the rotating arms 2114 may rotate toward the body 2108. As the rotating arms 2114 rotate toward the body 2108, the resilient bodies 2214 are compressed.

Figure 25:
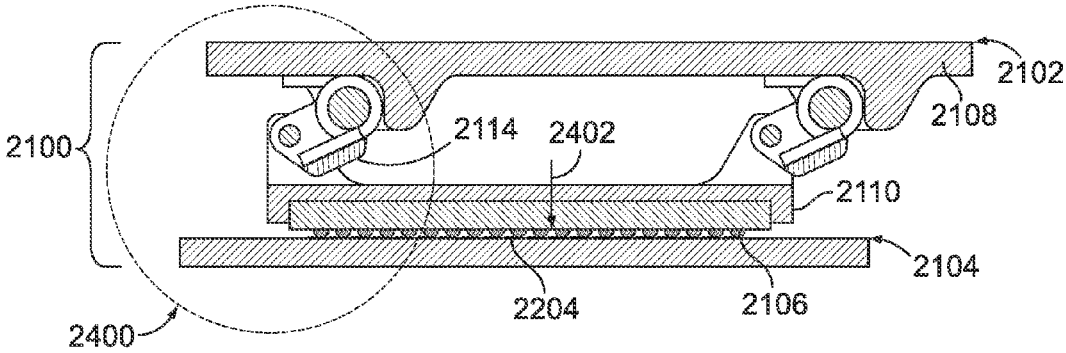
FIG. 25 is a cross-sectional view of the connector system shown in FIG. 22 in a partially mated state along line B-B in FIG. 22.
Figure 26:
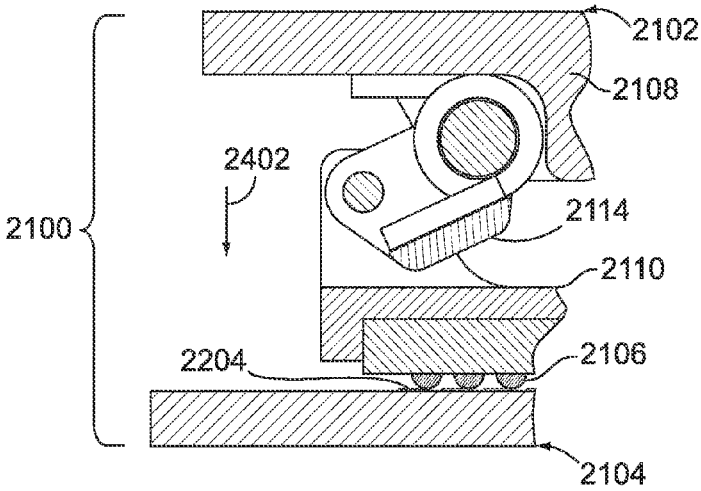
FIG. 26 is a detail view of a portion of the connector system shown in FIG. 25.

FIG. 25 is a cross-sectional view of the connector system 2100 in a partially mated state along line B-B in FIG. 22. FIG. 26 is a detail view of a portion 2400 of the connector system 2100 shown in FIG. 25. Similar to the connector system 1200 shown in FIG. 15, the first connector 2102 mates with the second connector 2104 by moving the first and/or second connectors 2102, 2104 toward each other. The connectors 2102, 2104 may be moved such that the first connector 2102 moves relative to the second connector 2104 along a mating direction 2402.

As shown in FIG. 26, when the contacts 2106 of the first connector 2102 initially engage the contacts 2204 of the second connector 2104, the contacts 2106, 2204 may not be aligned with each other. When the contacts 2106 engage the contacts 2204, the mating array 2110 may move toward the body 2108 of the first connector 2102. The mating array 2110 may be pushed toward the body 2108 such that the rotating arms 2114 rotate toward the body 2108.

Figure 27:
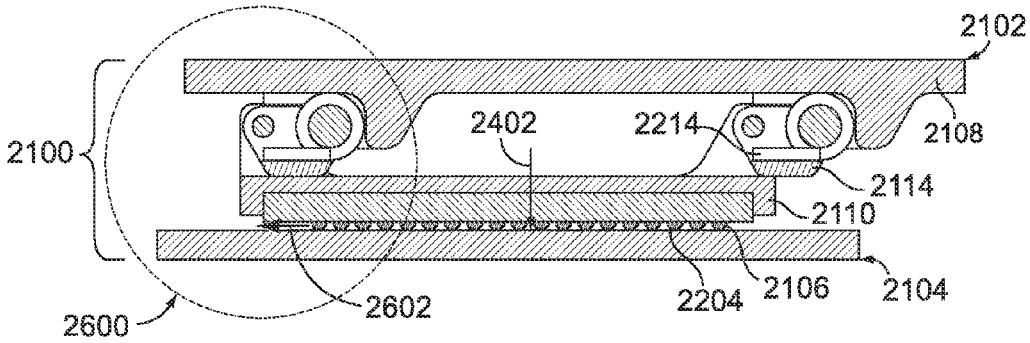
FIG. 27 is a cross-sectional view of the connector system shown in FIG. 22 in a mated state along line B-B in FIG. 22.
Figure 28:
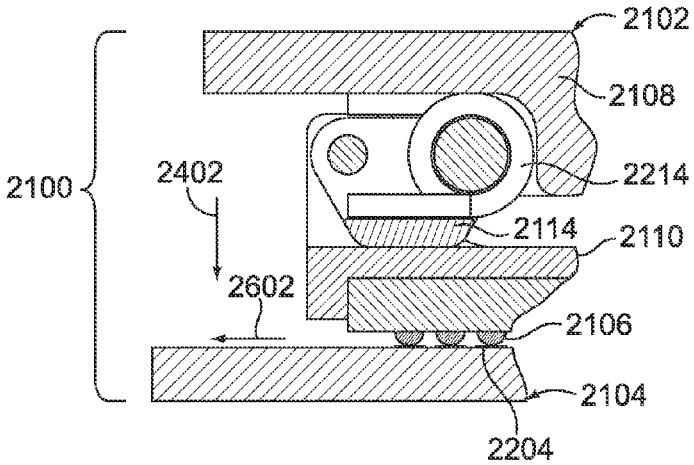
FIG. 28 is a detail view of a portion of the connector system shown in FIG. 27.

FIG. 27 is a cross-sectional view of the connector system 2100 in a mated state along line B-B in FIG. 22. FIG. 28 is a detail view of a portion 2600 of the connector system 2100 shown in FIG. 27. Similar to the connector system 1200 shown in FIG. 15, the first connector 2102 mates with the second connector 2104 by moving the first and/or second connectors 2102, 2104 toward each other. The connectors 2102, 2104 may be moved such that the first connector 2102 moves relative to the second connector 2104 along the mating direction 2402.

Once the contacts 2106 of the first connector 2102 engage the contacts 2204 of the second connector 2104, further movement of the first connector 2102 relative to the second connector 2104 in the mating direction 2402 causes the mating array 2110 to be pushed toward the body 2108 of the first connector 2102. As the mating array 2110 moves toward the body 2108, the rotating arms 2114 rotate toward the body 2108. The rotation of the rotating arms 2114 causes the mating array 2110 and the contacts 2106 of the first connector 2102 to move in a wiping direction 2602 relative to the contacts 2204 of the second connector 2104. The mating direction 2402 may be approximately perpendicular to the lateral wiping direction 2602. The lateral movement of the contacts 2106 across the contacts 2204 may remove one or more layers of surface contamination on the contacts 2204 such that the contacts 2106, 2204 are electrically coupled with one another. The contacts 2106 may wipe across the contacts 2204 such that the electrical connection between the contacts 2106 and the contacts 2204 is improved over contacts 2106 that do not wipe across the contacts 2204.

The resilient bodies 2214 are compressed between the rotating arms 2114 and the body 2108 when the connectors 2102, 2104 are mated. The compression of the resilient bodies 2214 causes the resilient bodies 2214 to exert forces on the mating array. When the connectors 2102, 2104 are moved away from each other, the forces exerted by the resilient bodies 2214 may cause the mating array 2110 to move away from the body 2108 and return to the position shown in FIGS. 20 and 21.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector comprising:

a housing comprising a front end with a channel inwardly extending from the front end;

a contact disposed in the channel, the contact elongated along a longitudinal axis and including a mating end and an interface end;

an angled interface slidably coupled to the interface end of the contact, the angled interface comprising a sliding surface oriented at an oblique angle with respect to the longitudinal axis;

a first resilient member coupled with the contact and the housing, the first resilient member configured to apply a first force to the contact in a direction that is angled with respect to the longitudinal axis; and a second resilient member coupled with the contact between the mating end and the interface end, the second resilient member applying a second force on the mating end toward the conductive element when the interface end slides along the angled interface, wherein the mating end of the contact engages a conductive element of a mating connector and the interface end of the contact slides along the sliding surface of the angled interface when the contact is moved in a mating direction toward the conductive element, the angled interface translating movement of the contact in the mating direction into lateral movement with respect to the mating direction across the conductive element.

2. The connector of claim 1, wherein the first force applied by the first resilient member moves the contact in a direction oriented opposite of the lateral movement when the contact is retreated away from the conductive element.

3. The connector of claim 1, wherein the interface end of the contact includes a side that is angled with respect to the longitudinal axis, the side sliding along the sliding surface when the contact moves in the mating direction and engages the conductive element.

4. The connector of claim 1, wherein the first resilient member is compressed between the housing and the contact when the contact laterally moves across along the conductive element.

5. The connector of claim 1, wherein the first resilient member is a spring.

6. The connector of claim 1, wherein the angled interface is electrically coupled with the contact through engagement between the interface end of the contact and the sliding surface of the angled interface.

7. The connector of claim 1, wherein the mating end of the contact removes surface contamination of the conductive element when the contact laterally moves across the conductive element.

8. The connector of claim 1, wherein the contact is separated into a mating section and a sliding section separated by a gap, further comprising a third resilient member coupled to the mating section and applying a third force to the mating section, the first resilient member coupled to the sliding section and applying the first force to the sliding section.

9. The connector of claim 1, wherein the channel of the housing extends between opposing end walls interconnected by opposing side walls, with the contact disposed between the end walls and moving parallel to the side walls as the contact laterally moves across the conductive element, wherein the side walls are separated by a width dimension that is sufficiently large to permit the contact to laterally move across the conductive element toward one of the end walls and the width dimension is sufficiently small to prevent movement of the contact in a direction that is angled with respect to the lateral movement of the contact.

10. The connector of claim 1, wherein the angled interface translates longitudinal movement of the contact in the mating direction into simultaneous lateral movement of the contact across the conductive element.

11. A connector comprising:

a housing;

a contact coupled with the housing, the contact having a mating end and an interface end;

an angled interface disposed within the housing and arranged for sliding engagement with the interface end of the contact;

a first resilient member disposed within the housing and coupled with the contact, the first resilient member imparting a lateral force on the contact in a direction that is oriented opposite of lateral movement of the contact; and a second resilient member coupled to the contact between the mating end and the interface end, the second resilient member applying a mating force on the mating end toward the conductive element when the interface end slides along the angled interface, wherein the mating end of the contact engages a conductive element of the mating connector when the housing is moved in a mating direction toward a mating connector such that further movement of the housing in the mating direction causes the interface end of the contact to slidably move along the angled interface, and wherein the angled interface imparts translational movement of the contact with respect to the housing and the mating end of the contact moves laterally across the conductive element.

12. The connector of claim 11, wherein the lateral force applied by the first resilient member moves the contact in a direction oriented opposite of the lateral movement when the contact is retreated away from the conductive element.

13. A connector comprising:

a housing having a channel with a conductive interface disposed in the channel;

a contact extending between a mating end and an interface end along an axis of the contact, the interface end including a resilient conductive member; and a cam pivotally connected with the housing and the contact, wherein the mating end of the contact engages a conductive element of a mating connector when the housing is moved in a direction along the axis of the contact toward the mating connector, the cam pivoting in the housing to translate movement of the housing into lateral movement of the mating end of the contact across the conductive element of the mating connector, and wherein the resilient conductive member of the contact is decoupled from the conductive interface in the housing prior to the cam translating the movement of the housing into the lateral movement of the mating end and the resilient conductive member of the contact is conductively coupled with the conductive interface in the housing after the cam translates the movement of the housing into the lateral movement of the mating end.

14. The connector of claim 13, wherein at least one of data or power is conveyed between the conductive interface of the housing and the conductive resilient member of the contact only when the cam has translated the movement of the housing to the lateral movement of the contact.

15. The connector of claim 13, wherein the cam is coupled with a spring that is compressed when the cam translates the movement of the housing into the lateral movement of the contact such that the spring pivots the cam to laterally return the contact when the housing is moved away from the mating connector.

16. A connector comprising:

a housing having a channel and an angled slot; and a contact disposed in the channel of the housing, the contact extending between a mating end and an interface end along an axis of the contact, the contact including a lateral pin disposed in the angled slot of the housing, wherein the lateral pin of the contact moves in the angled slot of the housing when the contact engages a conductive element of a mating connector in order to translate movement of the housing toward the mating connector into lateral movement of the mating end of the contact across the conductive element of the mating connector.

17. The connector of claim 16, wherein the interface end of the contact engages an conductive interface in the housing in order to convey at least one of data or power between the conductive interface and the interface end.

18. The connector of claim 16, wherein the contact is elongated along an axis from the mating end to the interface end and the angled slot of the housing is obliquely angled with respect to the axis of the contact.

19. A connector comprising:

a housing having a channel and an angled interface in the channel; and a contact disposed in the channel of the housing, the contact extending between a mating end and an interface end along an axis of the contact, the contact including a rotating member disposed at the interface end of the contact, wherein the rotating member rotates relative to the contact along the angled interface of the housing when the mating end engages a conductive element of a mating connector and the housing moves toward the mating connector, the rotating member rotating along the angled interface to translate the movement of the housing toward the mating connector into lateral movement of the mating end of the contact across the conductive element of the mating connector.

20. The connector of claim 19, wherein the contact extends from the mating end to the interface end along an axis and the angled interface of the housing is obliquely oriented with respect to the axis.

21. The connector of claim 19, wherein the rotating member of the contact is a cylindrical body that rotates about a post joined with the contact.

* * * * *